US009940856B2

(12) United States Patent
Hall

(10) Patent No.: US 9,940,856 B2
(45) Date of Patent: Apr. 10, 2018

(54) PREASSEMBLED DISPLAY SYSTEMS AND METHODS OF INSTALLATION THEREOF

(71) Applicant: Ultravision Technologies, LLC, Dallas, TX (US)

(72) Inventor: William Y. Hall, Dallas, TX (US)

(73) Assignee: ULTRAVISION TECHNOLOGIES, LLC, Dallas, TX (US)

( * ) Notice: Subject to any disclaimer, the term of this patent is extended or adjusted under 35 U.S.C. 154(b) by 0 days.

(21) Appl. No.: 15/390,277

(22) Filed: Dec. 23, 2016

(65) Prior Publication Data

US 2017/0110036 A1 Apr. 20, 2017

Related U.S. Application Data

(60) Division of application No. 14/641,189, filed on Mar. 6, 2015, now Pat. No. 9,528,283, which is a (Continued)

(51) Int. Cl.
*G09F 9/302* (2006.01)
*E06C 9/02* (2006.01)
(Continued)

(52) U.S. Cl.
CPC ..... *G09F 9/3026* (2013.01); *E04G 3/00* (2013.01); *E06C 9/02* (2013.01); *G09F 9/33* (2013.01); *G09F 15/0037* (2013.01)

(58) Field of Classification Search
CPC ..... G09F 9/3026; G09F 15/0037; G09F 9/33; E06C 9/02; E04G 3/00
See application file for complete search history.

(56) References Cited

U.S. PATENT DOCUMENTS 1,816,254 A 7/1931 Heath
3,150,455 A 9/1964 Indorf
(Continued)

FOREIGN PATENT DOCUMENTS

CN 201226214 Y 4/2009
CN 201449702 U 5/2010
(Continued)

OTHER PUBLICATIONS

International Search Report and Written Opinion received in International Application No. PCT/US2014/072373 dated May 27, 2015, 19 pages.
(Continued)

*Primary Examiner* — John C Hong
(74) *Attorney, Agent, or Firm* — Slater Matsil, LLP

(57) ABSTRACT

A preassembled display system is assembled at a first location by attaching a plurality of display panels to a frame. The preassembled display system is loaded onto a transportation vehicle. Next, the preassembled display system is moved to a second location in a transportation vehicle. The display unit is installed at the second location by attaching the preassembled display system to a mounting unit. A receiver box for providing media to display at the plurality of display panels is attached. The attaching of the receiver box may be performed at the first location and/or at the second location. The plurality of display panels are electrically connected to the receiver box. Again, the electrically connecting may be performed at the first location and/or at the second location.

20 Claims, 38 Drawing Sheets

Related U.S. Application Data continuation of application No. 14/582,908, filed on Dec. 24, 2014, now Pat. No. 9,416,551.

(60) Provisional application No. 62/093,157, filed on Dec. 17, 2014, provisional application No. 62/025,463, filed on Jul. 16, 2014, provisional application No. 61/922,631, filed on Dec. 31, 2013.

(51) Int. Cl.

| | |
|---|---|
| ***E04G 3/00*** | (2006.01) |
| ***G09F 15/00*** | (2006.01) |
| ***G09F 9/33*** | (2006.01) |

(56) References Cited

U.S. PATENT DOCUMENTS

| | | | |
|---|---|---|---|
| 4,457,090 | A | 7/1984 | McDonough |
| 4,497,125 | A | 2/1985 | Hutchinson |
| 4,782,336 | A | 11/1988 | Bailey |
| 4,964,231 | A | 10/1990 | De Maat et al. |
| 5,172,504 | A | 12/1992 | De Maat et al. |
| 5,341,088 | A | 8/1994 | Davis |
| 5,446,440 | A | 8/1995 | Gleason et al. |
| 5,523,769 | A | 6/1996 | Lauer et al. |
| 5,600,910 | A | 2/1997 | Blackburn |
| 5,722,767 | A | 3/1998 | Lin |
| 5,796,376 | A | 8/1998 | Banks |
| 5,900,850 | A | 5/1999 | Bailey et al. |
| 5,949,581 | A | 9/1999 | Kurtenbach et al. |
| 5,990,802 | A | 11/1999 | Maskeny |
| 6,045,240 | A | 4/2000 | Hochstein |
| 6,065,854 | A | 5/2000 | West et al. |
| 6,114,632 | A | 9/2000 | Planas, Sr. et al. |
| 6,169,632 | B1 | 1/2001 | Kurtenbach et al. |
| 6,175,342 | B1 | 1/2001 | Nicholson et al. |
| 6,237,290 | B1 | 5/2001 | Tokimoto et al. |
| 6,314,669 | B1 | 11/2001 | Tucker |
| 6,335,829 | B1 | 1/2002 | Van De Voorde |
| 6,362,801 | B1 | 3/2002 | Yuhara |
| 6,414,650 | B1 | 7/2002 | Nicholson et al. |
| 6,550,521 | B1 | 4/2003 | McNabb |
| 6,570,548 | B2 | 5/2003 | Smith |
| 6,634,124 | B1 | 10/2003 | Bierschbach |
| 6,657,605 | B1 | 12/2003 | Boldt, Jr. et al. |
| 6,677,918 | B2 | 1/2004 | Yuhara et al. |
| 6,737,983 | B1 | 5/2004 | Temple |
| 6,741,222 | B1 | 5/2004 | Tucker |
| 6,810,612 | B2 | 11/2004 | Huang |
| 6,813,853 | B1 | 11/2004 | Tucker |
| 6,819,303 | B1 | 11/2004 | Berger et al. |
| 6,998,538 | B1 | 2/2006 | Fetterolf, Sr. et al. |
| 7,055,271 | B2 | 6/2006 | Lutz et al. |
| 7,072,407 | B2 | 7/2006 | Schurig |
| 7,086,188 | B2 | 8/2006 | Tsao |
| 7,091,933 | B2 | 8/2006 | McClintock et al. |
| 7,161,558 | B1 | 1/2007 | Eidem et al. |
| 7,170,480 | B2 | 1/2007 | Boldt, Jr. et al. |
| 7,204,602 | B2 | 4/2007 | Archer |
| 7,267,459 | B2 | 9/2007 | Matheson |
| 7,268,501 | B1 | 9/2007 | Chen |
| 7,319,408 | B2 | 1/2008 | Temple |
| 7,334,361 | B2 | 2/2008 | Schrimpf et al. |
| 7,355,562 | B2 | 4/2008 | Schubert et al. |
| 7,450,085 | B2 | 11/2008 | Thielemans et al. |
| 7,495,576 | B2 | 2/2009 | Maskeny et al. |
| 7,502,950 | B1 | 3/2009 | Brands |
| 7,557,781 | B2 | 7/2009 | Chuang et al. |
| 7,605,772 | B2 | 10/2009 | Syrstad |
| 7,674,000 | B2 | 3/2010 | Valerio, Jr. et al. |
| 7,688,280 | B2 | 3/2010 | Callegari et al. |
| 7,694,444 | B2 | 4/2010 | Miller et al. |
| 7,703,941 | B2 | 4/2010 | Lee |
| 7,774,968 | B2 | 8/2010 | Nearman et al. |
| 7,779,568 | B2 | 8/2010 | Gettelfinger et al. |
| 7,797,865 | B2 | 9/2010 | Patel et al. |
| 7,868,903 | B2 | 1/2011 | Wendler et al. |
| 7,869,198 | B1 | 1/2011 | Nearman et al. |
| 7,907,133 | B2 | 3/2011 | Joffer et al. |
| 7,926,213 | B1 | 4/2011 | Kludt et al. |
| 7,950,174 | B2 | 5/2011 | Xu |
| 7,971,378 | B2 | 7/2011 | Campoy Odena |
| 8,007,121 | B2 | 8/2011 | Elliott et al. |
| 8,016,452 | B2 | 9/2011 | Dunn |
| 8,066,403 | B2 | 11/2011 | Sanfilippo et al. |
| 8,074,387 | B2 | 12/2011 | Mancuso |
| 8,081,145 | B2 | 12/2011 | Ronkholz et al. |
| 8,104,204 | B1 | 1/2012 | Syrstad |
| 8,111,208 | B2 | 2/2012 | Brown |
| 8,115,229 | B2 | 2/2012 | Christy |
| 8,122,627 | B2 | 2/2012 | Miller |
| 8,130,175 | B1 | 3/2012 | Joffer et al. |
| 8,136,279 | B1 | 3/2012 | Nearman et al. |
| 8,154,864 | B1 | 4/2012 | Nearman et al. |
| 8,156,672 | B2 | 4/2012 | Xu |
| 8,168,990 | B2 | 5/2012 | Christy |
| 8,172,097 | B2 | 5/2012 | Nearman et al. |
| 8,184,114 | B2 | 5/2012 | Oh et al. |
| 8,228,261 | B2 | 7/2012 | Callegari et al. |
| 8,281,344 | B1 | 10/2012 | Mathias |
| 8,301,939 | B2 | 10/2012 | Gloege et al. |
| 8,314,433 | B2 | 11/2012 | Christy |
| 8,344,410 | B2 | 1/2013 | Wendler et al. |
| 8,350,788 | B1 | 1/2013 | Nearman et al. |
| 8,362,696 | B2 | 1/2013 | Zheng |
| 8,410,993 | B2 | 4/2013 | Jenks et al. |
| 8,414,149 | B2 | 4/2013 | Nearman |
| 8,434,898 | B2 | 5/2013 | Sanfilippo et al. |
| 8,552,928 | B2 | 10/2013 | Wendler et al. |
| 8,558,755 | B2 | 10/2013 | Kharrati et al. |
| 8,599,108 | B2 | 12/2013 | Kline et al. |
| 8,604,509 | B2 | 12/2013 | Wendler et al. |
| 8,648,774 | B2 | 2/2014 | Kline et al. |
| 8,702,048 | B2 | 4/2014 | Kludt et al. |
| 8,714,665 | B2 | 5/2014 | Campagna et al. |
| 8,766,880 | B2 | 7/2014 | Kharrati et al. |
| 8,803,766 | B2 | 8/2014 | Kline et al. |
| 8,824,124 | B1 | 9/2014 | Carlson et al. |
| 8,824,125 | B1 | 9/2014 | Cox et al. |
| 8,963,895 | B2 | 2/2015 | Cope et al. |
| 9,013,367 | B2 | 4/2015 | Cope |
| 9,047,039 | B2 | 6/2015 | Perkins et al. |
| 9,047,791 | B2 | 6/2015 | Cox et al. |
| 9,058,755 | B2 | 6/2015 | Cope et al. |
| 9,071,809 | B2 | 6/2015 | Cope et al. |
| 9,167,191 | B2 | 10/2015 | Kondo et al. |
| 9,330,589 | B2 | 5/2016 | Cope et al. |
| 9,416,551 | B2 | 8/2016 | Hall |
| 9,655,267 | B2 | 5/2017 | Cope et al. |
| 2004/0008155 | A | 1/2001 | Cok |
| 2001/0037591 | A1 | 11/2001 | Nicholson et al. |
| 2004/0222941 | A1 | 11/2001 | Wong et al. |
| 2002/0176267 | A1 | 11/2002 | Tanaka et al. |
| 2003/0117420 | A1 | 6/2003 | Ando et al. |
| 2003/0146882 | A1 | 8/2003 | Ogino et al. |
| 2003/0158886 | A1 | 8/2003 | Walls et al. |
| 2004/0090391 | A1 | 5/2004 | Kondo |
| 2004/0104871 | A1 | 6/2004 | Boldt, Jr. et al. |
| 2004/0186723 | A1 | 9/2004 | Mizutani et al. |
| 2004/0196049 | A1 | 10/2004 | Yano et al. |
| 2004/0240230 | A1 | 12/2004 | Kitajima et al. |
| 2005/0052374 | A1 | 3/2005 | Devos et al. |
| 2005/0052375 | A1 | 3/2005 | Devos et al. |
| 2005/0078104 | A1 | 4/2005 | Matthies et al. |
| 2005/0116667 | A1 | 6/2005 | Mueller et al. |
| 2005/0134525 | A1 | 6/2005 | Tanghe et al. |
| 2005/0134526 | A1 | 6/2005 | Willem et al. |
| 2005/0178034 | A1 | 8/2005 | Schubert et al. |
| 2005/0189311 | A1 | 9/2005 | Colby et al. |
| 2005/0190520 | A1 | 9/2005 | Schomaker et al. |
| 2005/0264471 | A1 | 12/2005 | Yamazaki et al. |
| 2006/0031720 | A1 | 2/2006 | Choi |
| 2006/0039142 | A1 | 2/2006 | Temple |
| 2006/0132048 | A1 | 6/2006 | Popovich |

(56) References Cited

U.S. PATENT DOCUMENTS

| | | | |
|---|---|---|---|
| 2006/0164587 | A1 | 7/2006 | Oh |
| 2006/0164758 | A1 | 7/2006 | Oh |
| 2006/0170614 | A1 | 8/2006 | Tzong et al. |
| 2006/0185612 | A1 | 8/2006 | Bonner et al. |
| 2006/0241878 | A1 | 10/2006 | Jung et al. |
| 2006/0242871 | A1 | 11/2006 | Kondo et al. |
| 2006/0256033 | A1 | 11/2006 | Chan et al. |
| 2007/0000849 | A1 | 1/2007 | Lutz et al. |
| 2007/0241988 | A1 | 10/2007 | Lerphy et al. |
| 2007/0279314 | A1 | 12/2007 | Brown |
| 2008/0047184 | A1 | 2/2008 | Dean |
| 2008/0078733 | A1 | 4/2008 | Nearman et al. |
| 2008/0141571 | A1 | 6/2008 | Kottwitz |
| 2008/0266206 | A1 | 10/2008 | Nelson et al. |
| 2008/0285087 | A1 | 11/2008 | Perkins et al. |
| 2008/0303747 | A1 | 12/2008 | Velicescu |
| 2009/0021532 | A1 | 1/2009 | Gloege et al. |
| 2009/0024929 | A1 | 1/2009 | Gloege et al. |
| 2009/0073080 | A1 | 3/2009 | Meersman et al. |
| 2009/0096711 | A1 | 4/2009 | Jang et al. |
| 2009/0146910 | A1 | 6/2009 | Gardner |
| 2009/0146919 | A1 | 6/2009 | Kline et al. |
| 2009/0147028 | A1 | 6/2009 | Sefton et al. |
| 2009/0251391 | A1 | 10/2009 | Ng et al. |
| 2009/0289160 | A1 | 11/2009 | Kludt et al. |
| 2009/0322251 | A1 | 12/2009 | Hilgers |
| 2010/0026973 | A1 | 2/2010 | Hemphill et al. |
| 2010/0045689 | A1 | 2/2010 | Hsieh |
| 2010/0123732 | A1 | 5/2010 | Jenks et al. |
| 2010/0251583 | A1 | 10/2010 | Brown et al. |
| 2010/0288895 | A1 | 11/2010 | Shamie |
| 2010/0295424 | A1 | 11/2010 | Alexander |
| 2010/0295760 | A1 | 11/2010 | Somerville |
| 2010/0309185 | A1 | 12/2010 | Koester et al. |
| 2011/0025696 | A1 | 2/2011 | Wyatt et al. |
| 2011/0096568 | A1 | 4/2011 | Schattinger et al. |
| 2011/0116232 | A1 | 5/2011 | Brown et al. |
| 2011/0134640 | A1 | 6/2011 | Bertele |
| 2011/0140999 | A1 | 6/2011 | Beland et al. |
| 2011/0168653 | A1 | 7/2011 | Garrett et al. |
| 2011/0181493 | A1 | 7/2011 | Williams et al. |
| 2011/0205757 | A1 | 8/2011 | Whyte |
| 2011/0267328 | A1 | 11/2011 | Venkatasubramanian et al. |
| 2012/0005563 | A1 | 1/2012 | Gloege et al. |
| 2012/0019490 | A1 | 1/2012 | Huang |
| 2012/0021873 | A1 | 1/2012 | Brunner |
| 2012/0062540 | A1 | 3/2012 | Quadri et al. |
| 2012/0112235 | A1 | 5/2012 | Preuschl et al. |
| 2012/0218753 | A1 | 8/2012 | Joffer et al. |
| 2012/0218758 | A1 | 8/2012 | Wang et al. |
| 2002/0126086 | A1 | 9/2012 | Takeuchi et al. |
| 2012/0236509 | A1 | 9/2012 | Cope et al. |
| 2012/0248950 | A1 | 10/2012 | Nibori |
| 2012/0299480 | A1 | 11/2012 | Peting et al. |
| 2013/0002634 | A1 | 1/2013 | Wendler et al. |
| 2013/0182440 | A1 | 7/2013 | Ferrie et al. |
| 2013/0271973 | A1 | 10/2013 | Rycyna, III |
| 2013/0279161 | A1 | 10/2013 | Pickard et al. |
| 2013/0321387 | A1 | 12/2013 | Ohe |
| 2014/0259645 | A1 | 9/2014 | Cox et al. |
| 2014/0267784 | A1 | 9/2014 | Rykowski |
| 2014/0267896 | A1 | 9/2014 | Cox et al. |
| 2014/0268565 | A1* | 9/2014 | Cox ..... H05K 5/0017 361/692 |
| 2014/0285963 | A1 | 9/2014 | Vasilevsky |
| 2015/0145851 | A1 | 5/2015 | Takeda et al. |
| 2015/0205565 | A1 | 7/2015 | Koguchi |

FOREIGN PATENT DOCUMENTS

| | | | |
|---|---|---|---|
| CN | 201540699 | U | 8/2010 |
| CN | 202383944 | U | 8/2012 |
| CN | 103280164 | A | 9/2013 |
| CN | 203250491 | U | 10/2013 |
| CN | 203607050 | U | 5/2014 |
| WO | 2005083660 | A1 | 9/2005 |
| WO | 2014005600 | A2 | 1/2014 |

OTHER PUBLICATIONS

Daktronics, "Daktronics LED Billboard Technology," www.daktronics.com Nov. 14, 2013, 3 pages.

Daktronics, "The Smarter Approach to Digital Outdoor," Daktronics Digital Billboard Products, 2013, 16 pages.

Ekta, "WOWStrip," www.ekta-led.com, Jun. 19, 2014, 5 pages.

"What is IP? Explained: Ingress Protection rating (IP Rating, IP65-1P68) system," Waterproof TVs Direct; Apr. 11, 2012; http://waterproftvs-direct.co.uk/blog/waterproof-tv/what-is-ip-ip-explained-ingress-protection-rating-ip-rating-ip65-ip68-system.

WOWstrip Semi-Transparent LED Displays product page, http://www.ekta-led.com/prod/68/17/190/, retrieved Jun. 19, 2014, 3 pages.

UK Intellectual Property Office, Search Report Cited by the Examiner in Application No. GB1518912.9 dated Mar. 2, 2016, pp. 1-6.

Lighthouseled, "Possibilities" and "Specifications," Aug. 9, 2013, 1 page.

Samsung, "User Manual, UD22B," B146-00286A-02, Jul. 2012, 145 pages.

Prismview, A Samsung Electronics Company, "Deploying a Digital Billboard with Prismview, Steps from Contracting Through Installation," White Paper, Aug. 2012, 4 pages.

YESCO Electronics, "The Layered Service Approach for Digital Outdoor Displays," White Paper, YESCO Electronics Service Plans, Aug. 2012, 6 pages.

Lighthouse Create Impact, "10mm Visual Resolution with Oval LEDs, Bi10-ER, Large Scale LED Panel, A Modular System for Outdoor Applications," Operation Manual, Jul. 2011; Document version 1.3; 33 pages.

CYsn, Glux Visual Effects Tech (Shenzhen) Co., Ltd, http://www.glux.cc/business-provide-self-cysn.html, Oct. 1, 2013, 2 pages.

MOtn, Glux Visual Effects Tech (Shenzhen) Co., Ltd, http://www.glux.cc/business-provide-self-cysn.html, Oct. 1, 2013, 2 pages.

SEfl, Glux Visual Effects Tech (Shenzhen) Co., Ltd, http://www.glux.cc/business-provide-self-cysn.html, Oct. 1, 2013, 2 pages.

English Translation of Previously cited CN 203607050U, Published on May 21, 2014, Shenzhen Aoto Electronics Co., Ltd., 6 pages.

* cited by examiner

PREASSEMBLED DISPLAY SYSTEMS AND METHODS OF INSTALLATION THEREOF

CROSS-REFERENCE TO RELATED APPLICATIONS

This application is a divisional of U.S. application Ser. No. 14/641,189 filed on Mar. 6, 2015, which is a continuation of U.S. application Ser. No. 14/582,908 filed on Dec. 24, 2014, which claims the benefit of each of the following applications: U.S. Provisional Application No. 62/093,157, filed on Dec. 17, 2014, U.S. Provisional Application No. 62/025,463, filed on Jul. 16, 2014, and U.S. Provisional Application No. 61/922,631, filed on Dec. 31, 2013. The above listed applications are hereby incorporated herein by reference.

TECHNICAL FIELD

The present invention relates generally to displays, and, in particular embodiments, to preassembled display systems and methods of installation thereof.

BACKGROUND

Large displays (e.g., billboards), such as those commonly used for advertising in cities and along roads, generally have one or more pictures and/or text that are to be displayed under various light and weather conditions. As technology has advanced and introduced new lighting devices such as the light emitting diode (LED), such advances have been applied to large displays.

However, installation of such large displays is time consuming and an expensive operation. Further, the operating costs of these large displays may be large due to the difficulty of servicing such displays.

SUMMARY

Example embodiments of the present disclosure provide a system and method for installing preassembled modular display panels.

In accordance with an example embodiment of the present invention, a preassembled display system is assembled at a first location by attaching a plurality of display panels to a frame. The preassembled display system may be at least 6 ft.×12 ft. The preassembled display system is loaded onto a transportation vehicle. Next, the preassembled display system is moved to a second location in a transportation vehicle. The display unit is installed at the second location by attaching the preassembled display system to a mounting unit. A receiver box for providing media to display at the plurality of display panels is attached. The attaching of the receiver box may be performed at the first location and/or at the second location. The plurality of display panels are electrically connected to the receiver box. Again, the electrically connecting may be performed at the first location and/or at the second location.

In accordance with another example embodiment of the present invention, a plurality of display sections is assembled at a first location. Each display section includes a plurality of display panels mechanically attached to a frame. The assembled display sections are transported from the first location to a second location that is at least five miles away from the first location. The plurality of display sections is mounted at the second location to install the display unit.

The display unit may be installed by attaching the frame of each display section to the frame of at least one other display section.

In accordance with another example embodiment of the present invention, a method of performing an installation of a display unit includes forming a preassembled display system at a first location by attaching a plurality of display panels to a frame, the preassembled display system being at least 6 ft.×12 ft. The preassembled display system is loaded onto a transportation vehicle and moved toward a second location in the transportation vehicle. At the second location, a preexisting display mounted on a mounting frame of a billboard is removed. The preassembled display system is lifted up as a single unit to the mounting frame and the preassembled display system is attached to the mounting frame of the billboard.

In accordance with another example embodiment of the present invention, a method of performing an installation of a display unit includes forming a preassembled display system at a first location by attaching a plurality of display panels to a frame, the preassembled display system being at least 6 ft.×12 ft. The preassembled display system is loaded onto a transportation vehicle and the transportation vehicle with the preassembled display system is moved toward a second location. At the second location, the preassembled display system is lifted up as a single unit to a mounting point on a wall of a building and the preassembled display system is attached to the mounting point.

In accordance with another embodiment of the present invention, a method of installing modular display panels includes forming a preassembled display system at a first location by attaching a plurality of display panels to a frame, attaching a receiver box for providing media to display at the plurality of display panels, and electrically connecting the plurality of display panels to the receiver box. The preassembled display system is then shipped from the first location to a second location.

In accordance with another embodiment of the present invention, a method of installing modular display panels includes receiving a preassembled display system assembled at a first location, the preassembled display system comprising a plurality of display panels attached to a frame comprising a plurality of vertical beams, and a receiver box attached to the frame, and configured to provide media to display at the plurality of display panels, the plurality of display panels being electrically connected to the receiver box. At a second location, a preexisting display mounted on a mounting frame of a billboard is removed. The preassembled display system is attached to the mounting frame.

BRIEF DESCRIPTION OF THE DRAWINGS

For a more complete understanding of the present invention, and the advantages thereof, reference is now made to the following descriptions taken in conjunction with the accompanying drawings, in which:

FIGS. 7A-7C illustrate alternative embodiments of the modular display panel attached to a supporting frame in accordance with embodiments of the present invention, wherein FIG. 7A illustrates a view highlighting the supporting frame, and wherein FIGS. 7B and 7C illustrate alternative structural embodiments of the supporting frame;

FIGS. 11A-11D illustrate embodiments of the present invention for forming a large display panel by installing a plurality of preassembled display units or display sections, wherein FIG. 11A is a projection view, wherein FIG. 11B illustrates one example embodiment of the mechanical features used to align and/or mechanically support the plurality of preassembled display units, wherein FIG. 11C illustrates another embodiment in which some of the first features and second features may be interchanged to form a tighter fit, and wherein FIG. 11D illustrates a further embodiment showing additional adjustment features for adjusting the vertical and horizontal distance between adjacent preassembled display units;

FIGS. 12A-12C illustrate an on-site wall mounting of a preassembled display unit in accordance with embodiments of the present invention, wherein FIG. 12A illustrates a front view of the mounting wall and FIG. 12B illustrates a side view illustrating the mounting wall and the mounted preassembled display unit, wherein FIG. 12C illustrates a side view of a further embodiment in which the plurality of beams is directly mounted to the mounting wall;

FIGS. 14A-14D illustrate specific examples of an assembled display system, wherein FIG. 14A illustrates that the modular preassembled display unit includes a number of display panels mounted to a frame, wherein a side view of the display system is shown in FIG. 14B and back views are shown in FIGS. 14C and 14D;

FIGS. 14E-14G illustrate specific examples of a cage without the display panels that can be used with the system of FIGS. 14A-14D, wherein FIG. 14E illustrates the cage without the display panels, wherein other views of the frame are shown in FIGS. 14F and 14G;

FIGS. 15A-15E illustrate specific examples of an assembled display system, wherein FIG. 15A illustrates a preassembled display system in accordance with an embodiment of the present invention, wherein FIG. 15B illustrates a magnified view of the preassembled display system illustrated in FIG. 15A in accordance with an embodiment of the present invention, wherein FIG. 15C illustrates a preassembled display system including a non-linear shape in accordance with an embodiment of the present invention, wherein FIG. 15D illustrates a magnified portion of the base of a preassembled display system including a non-linear shape in accordance with an embodiment of the present invention, wherein FIG. 15E illustrates a preassembled display unit in which a receiver box is installed;

FIGS. 17A-17F illustrate different projection views of a preassembled display system illustrating the features used for stacking and alignment in accordance with an embodiment of the present invention, wherein FIG. 17A illustrates a preassembled display system in accordance with an embodiment of the present invention, wherein FIG. 17B illustrates another magnified projection view of the cage showing the platform and the second joining feature, wherein FIG. 17C illustrates a side projection view of the cage showing the platform and the second joining feature, wherein FIG. 17D illustrates a magnified projection view of another side of a cage showing a jack screw and a first joining feature, wherein FIG. 17E illustrates another magnified projection view showing the first joining feature and the jack screw, and wherein FIG. 17F illustrates a magnified back side projection view showing the first joining feature and the jack screw;

DETAILED DESCRIPTION OF ILLUSTRATIVE EMBODIMENTS

Installation of large display panels is a labor intensive process requiring skilled labor working in dangerous conditions for extended times. For example, to install a conventional display on a large multi-story building, the installers have to climb to the mounting wall (typically many stories high) and individually screw in each display and the corresponding cables etc. This is both time consuming and poses a significant safety threat thereby increasing the cost of the system dramatically.

Embodiments of the invention provide preassembled display panel units, each of which provides a completely self-contained building block that is lightweight. Because of the light weight capabilities, most of the assembly of the display units may be performed at a factory, assembly facility, or warehouse rather than on-site dramatically lowering the system cost.

These display units are designed to be weather proof, without a heavy cabinet, although it is understood that the present disclosure may be applied to lighting for any type of interior and/or exterior display. The lightweight design allows for easier installation and maintenance, thus lowering total cost of ownership.

Embodiments of the invention provide building block panels that are configurable with future expandability. These displays can offer complete expandability to upgrade in the future without having to replace the entire display. Installation is fast and easy with very little down-time, which allows any electronic message to be presented more quickly.

In some embodiments, the display panels are "hot swappable." By removing one screw in each of the four corners of the panel, servicing the display panel is fast and easy. Since a highly-trained, highly-paid electrician or technician is not needed to correct a problem, cost benefits can be achieved.

Figure 1:
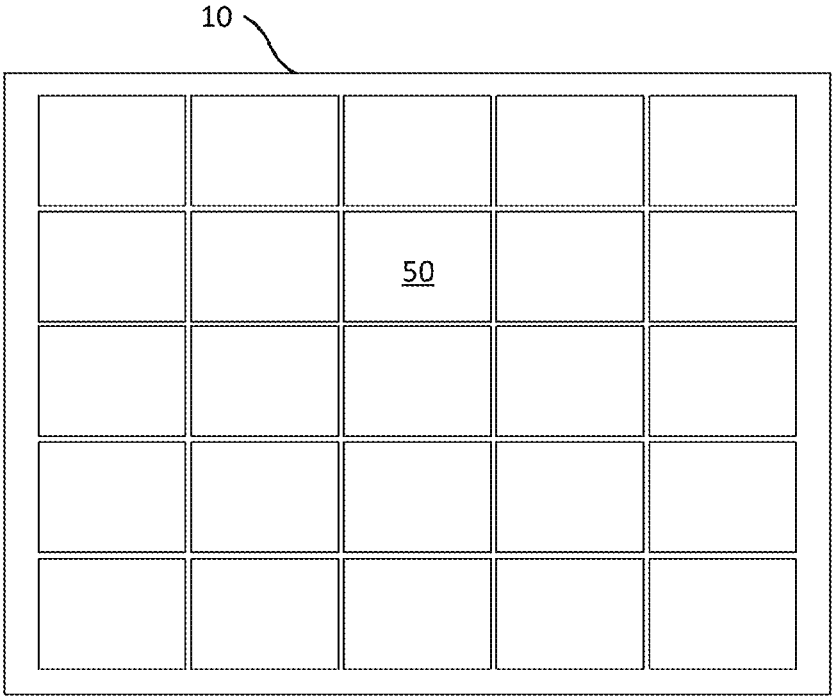
FIG. 1 illustrates a modular multi-resolution display system in accordance with embodiments of the present invention.
Figure 2:
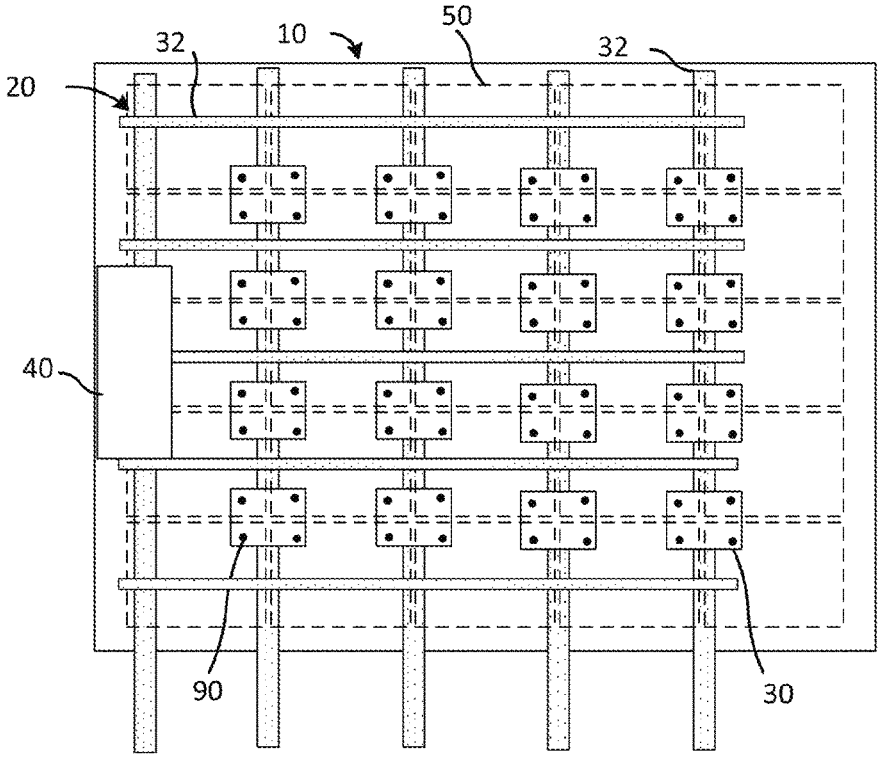
FIG. 2 illustrates a modular display panel attached to a supporting frame in accordance with an embodiment of the present invention.
Figure 3:
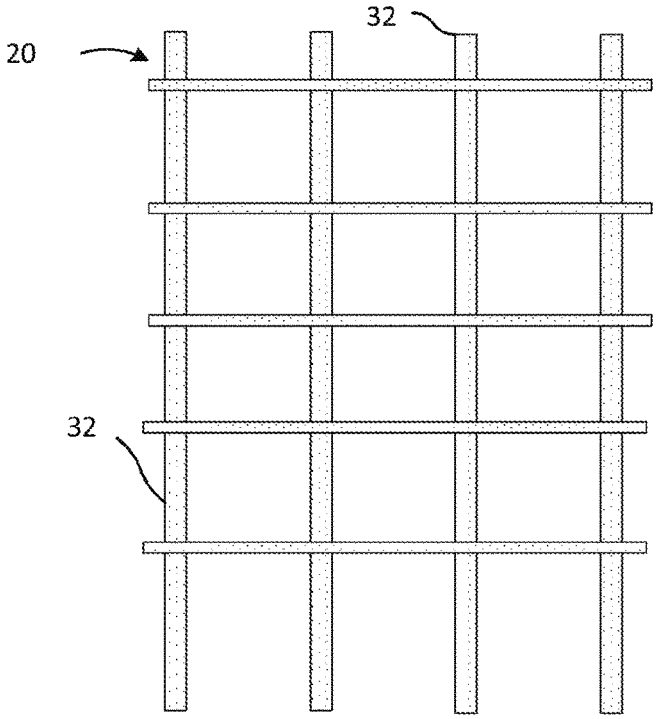
FIG. 3 illustrates a frame used to provide mechanical support to the modular display panel in accordance with an embodiment of the present invention.

FIG. 1 illustrates a modular display panel in accordance with an embodiment of the present invention. FIG. 2 illustrates a modular display panel attached to a supporting frame in accordance with an embodiment of the present invention. FIG. 3 illustrates a frame used to provide mechanical support to the modular display panel in accordance with an embodiment of the present invention.

The multi-panel modular preassembled display unit 10 comprises a plurality of LED display panels 50. In various embodiments describe herein, the light emitting diode (LED) display panels 50 are attached to a frame 20 or skeletal structure that provides the framework for supporting the LED display panels 50. The LED display panels 50 are stacked next to each other and securely attached to the frame 20 using attachment plate 30, which may be a corner plate in one embodiment. The attachment plate 30 may comprise holes through which attachment features 90 may be screwed in, for example.

Referring to FIGS. 1 and 2, the LED display panels 50 are arranged in an array of rows and columns. Each LED display panel 50 of each row is electrically connected to an adjacent LED display panel 50 within that row.

Referring to FIG. 3, the frame 20 provides mechanical support and electrical connectivity to each of the LED display panels 50. The frame 20 comprises a plurality of beams 32 forming the mechanical structure. The frame 20 comprises a top bar, a bottom bar, a left bar, a right bar, and a plurality of vertical bars extending from the top bar to the bottom bar, the vertical bars disposed between the left bar and the right bar. The top bar, the bottom bar, the left bar and the right bar comprise four inch aluminum bars, and the vertical bars comprise 2"×4"×½" aluminum tubes. The top bar, the bottom bar, the left bar and the right bar are each capable of bearing a load of 1.738 lb/ft and the vertical bars are each capable of bearing a load of 3.23 lb/ft.

The frame 20 may include support structures for the electrical cables, data cables, electrical power box powering the LED displays panels 50, and the data receiver box controlling power, data, and communication to the LED displays panels 50.

However, the frame 20 does not include any additional enclosures to protect the LED panels, data and power cables from the environment. Rather, the frame 20 is exposed to the elements and further exposes the LED display panels 50 to the environment. The frame 20 also does not include air conditioning, fans, or heating units to maintain the temperature of the LED display panels 50. Rather, the LED display panels 50 are hermetically sealed themselves and are designed to be exposed to the outside ambient. Further, in various embodiments, there are no additional cabinets that are attached to the frame 20 or used for housing the LED display panels 50. Accordingly, in various embodiments, the multi-panel modular preassembled display unit 10 is designed to be only passively cooled.

Figure 4:
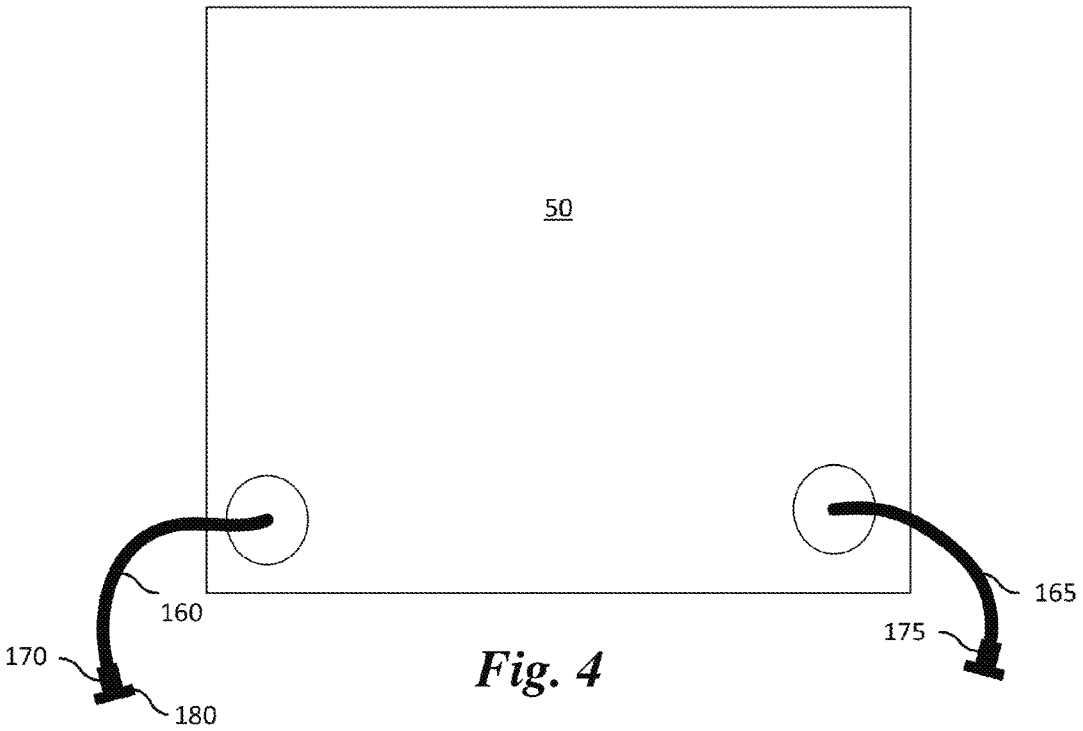
FIG. 4 illustrates one unit of the modular display panel in accordance with an embodiment of the present invention.

FIG. 4 illustrates one display panel 50 of the multi-panel modular preassembled display unit 10 comprising an input cable 160 and an output cable 165. The LED display panels 50 are electrically connected together for data and for power using the input cable 160 and the output cable 165.

Each modular LED display panel 50 is capable of receiving input using an integrated data and power cable from a preceding modular LED display panel and providing an output using another integrated data and power cable to a succeeding modular LED display panel. Each cable ends with an endpoint device or connector, which is a socket or alternatively a plug.

Referring to FIG. 4, in accordance with an embodiment, a LED display panel 50 comprises an attached input cable 160 and an output cable 165, a first connector 170, a second connector 175, and a sealing cover 180. The sealing cover 180 is configured to go over the second connector 175 thereby hermetically sealing both ends (first connector 170 and the second connector 175). The sealing cover 180, which also includes a locking feature, locks the two cables together securely. The input cable 160 and the output cable 165 comprise integrated data and power wires with appropriate insulation separating them.

As an example, an LED panel includes a substrate that forms a front surface of the panel. The substrate in the present example is rectangular in shape, with a top edge, a bottom edge, a right edge, and a left edge. A substrate surface includes "pixels" that are formed by one or more LEDs on or within the substrate. In the present example, each pixel includes four LEDs arranged in a pattern (e.g., a square). For example, the four LEDs that form a pixel may include a red LED, a green LED, a blue LED, and one other LED (e.g., a white LED). In some embodiments, the other LED may be a sensor. It is understood that more or fewer LEDs may be used to form a single pixel, and the use of four LEDs and their relative positioning as a square are for purposes of illustration only.

In some embodiments, the substrate may form the entire front surface of the panel, with no other part of the panel being visible from the front when the substrate is in place. In other embodiments, a housing may be partially visible at one or more of the edges of the substrate. The substrate may form the front surface of the panel, but may not be the outer surface in some embodiments. For example, a transparent or translucent material or coating may overlay the substrate and the LEDs, thereby being positioned between the substrate/LEDs and the environment.

The housing defines a cavity. Structural cross-members may be used to provide support to a substrate (e.g., the substrate of the present example). The cross-members, as well as other areas of the housing, may include supports against which the substrate can rest when placed into position. As shown, the supports may include a relatively narrow tip section that can be inserted into a receiving hole in the back of the substrate and then a wider section against which the substrate can rest.

Figure 5:
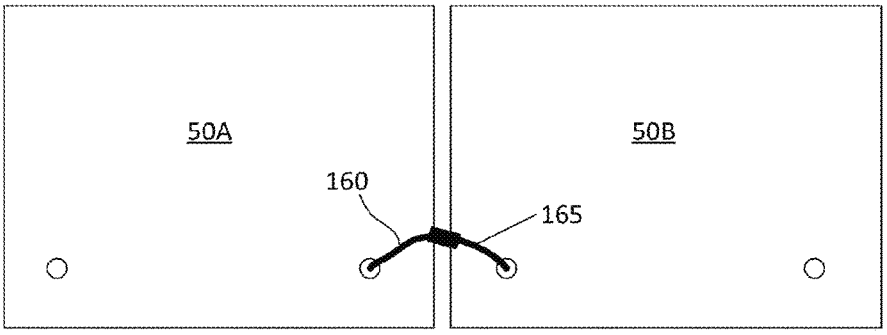
FIG. 5 illustrates a magnified view of two display panels next to each other and connected through the cables such that the output cable of the left display panel is connected with the input cable of the next display panel in accordance with an embodiment of the present invention.

FIG. 5 illustrates two display panels next to each other and connected through the cables such that the output cable 165 of the left display panel 50A is connected with the input cable 160 of the next display panel 50B. The sealing cover 180 locks the two cables together as described above.

Figure 6:
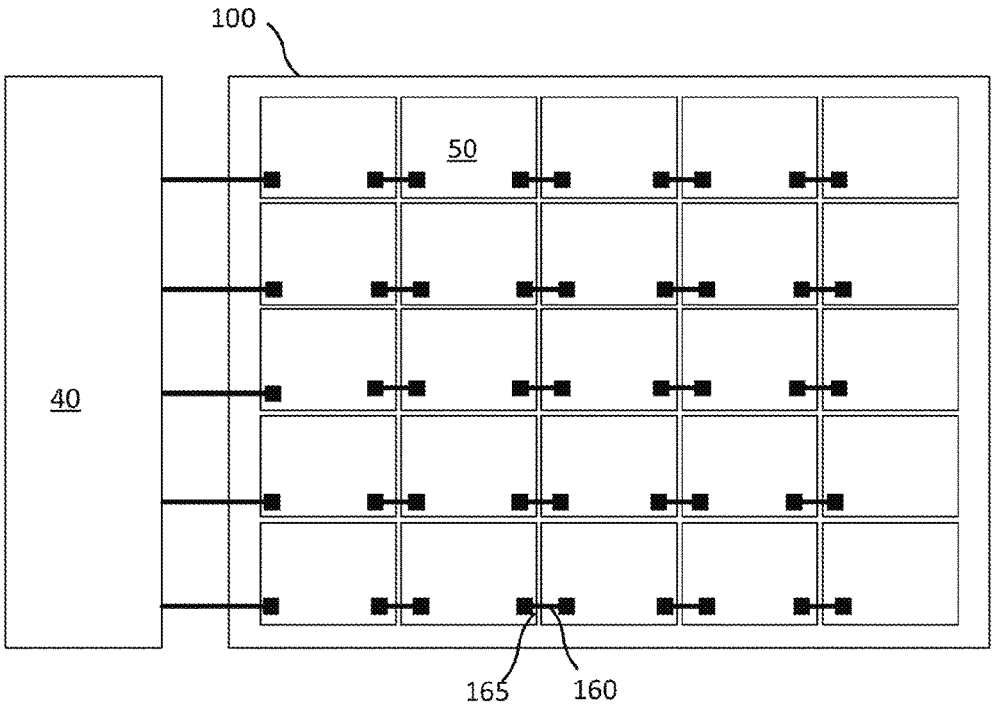
FIG. 6 illustrates a modular multi-panel display system comprising a plurality of LED display panels connected together using the afore-mentioned cables in accordance with an embodiment of the present invention.

FIG. 6 illustrates a modular multi-panel display system comprising a plurality of LED display panels connected together using the afore-mentioned cables.

Referring to FIG. 6, for each row, a LED display panel 50 at a first end receives an input data connection from a data source and has an output data connection to a next LED display panel in the row. Each further LED display panel 50 provides data to a next adjacent LED display panel until a LED display panel 50 at second end of the row is reached. The power line is run across each row to power the LED display panels 50 in that row.

In one embodiment, the plurality of LED display panels 50 are arranged in ten rows and thirty-two columns so that the integrated display panel 100 has a display surface that is approximately fifty feet and four inches wide and fifteen feet and eight and three-quarters inches high.

In various embodiments, as illustrated in FIGS. 2 and 6, a data receiver box 40 is mounted to the mechanical support structure or frame 20. The data receiver box 40 is configured to provide power, data, and communication to the LED display panels 50. With a shared receiver box 40, the panels themselves do not need their own receiver card. This configuration saves cost and weight.

Figure 7A:
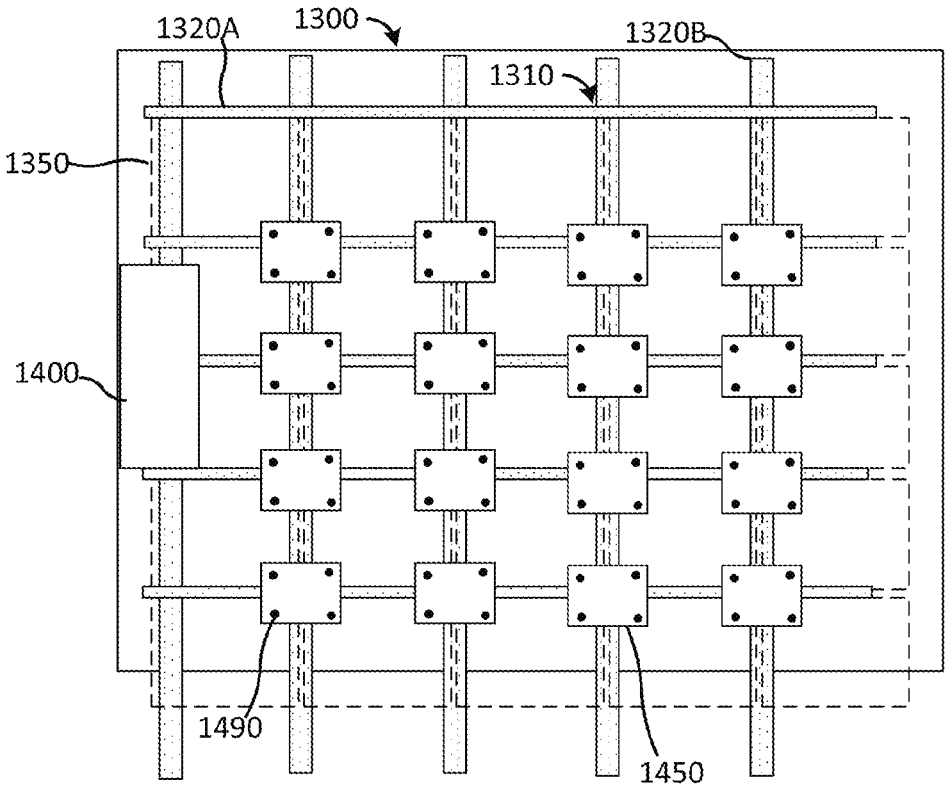
Figure 7B:
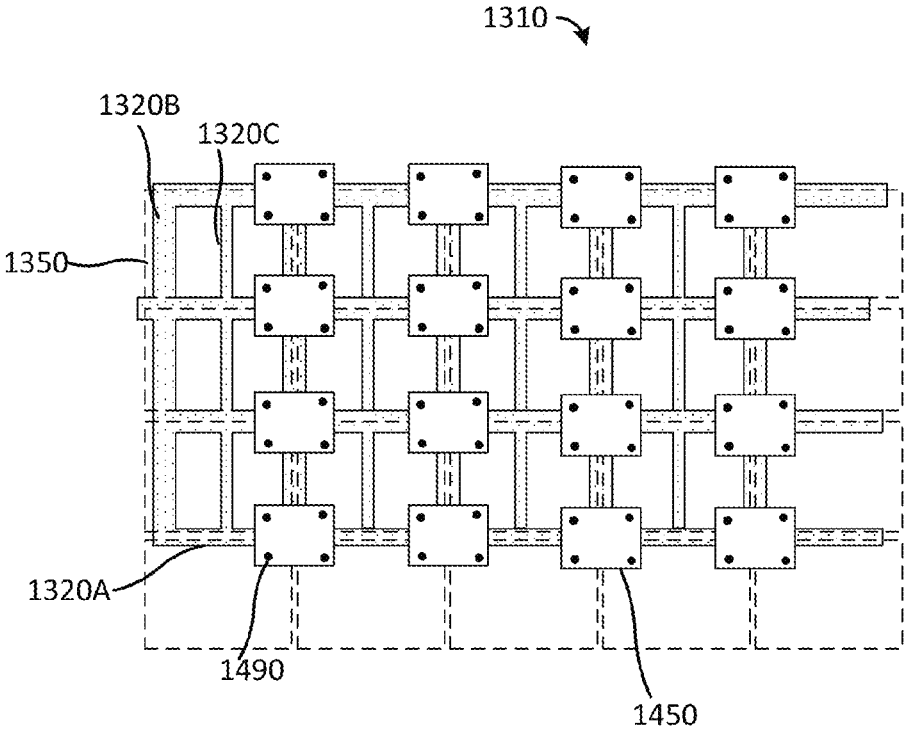
Figure 7C:
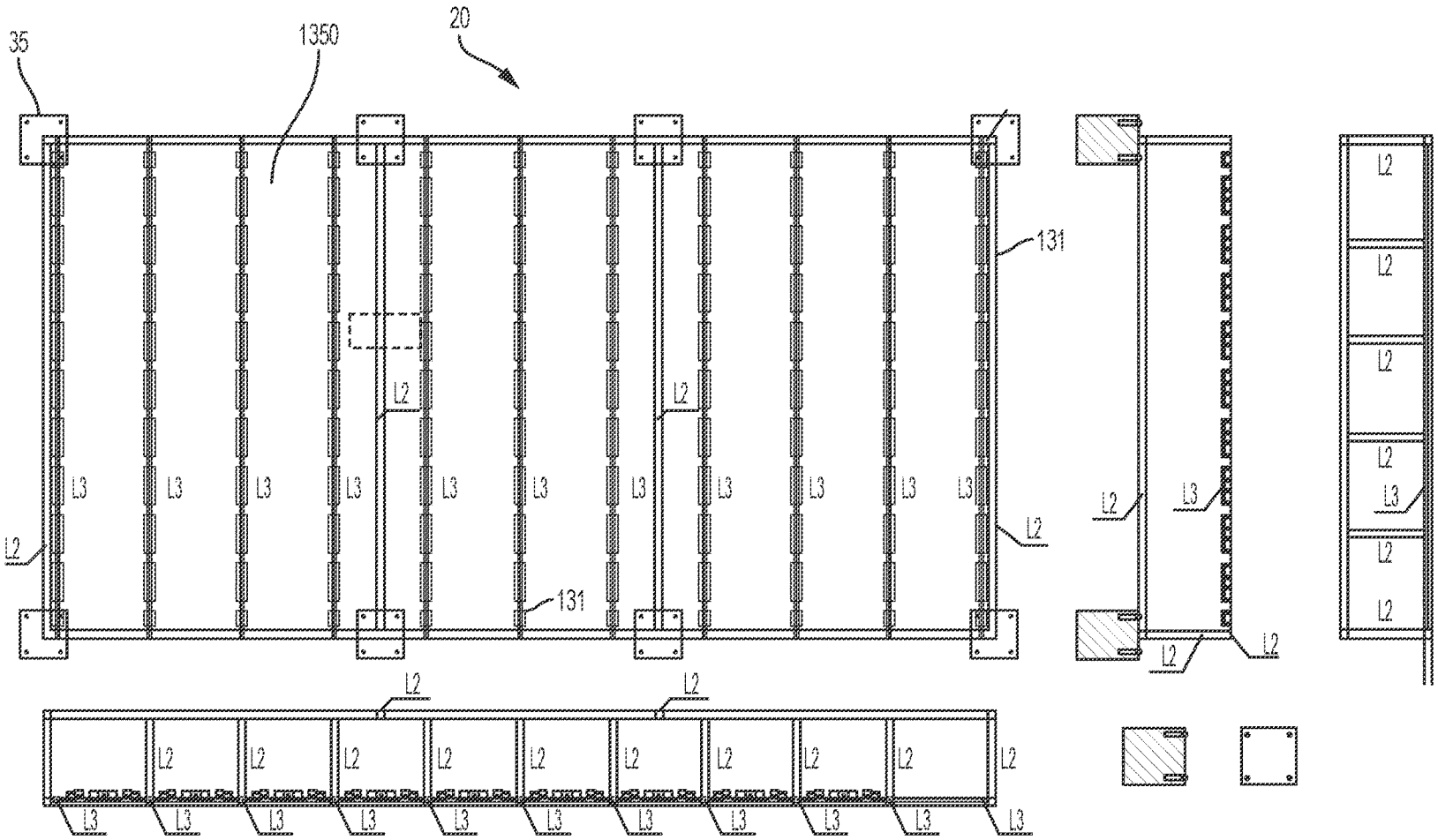

FIG. 7, which includes FIGS. 7A-7C, illustrates alternative embodiments of the modular display panel attached to a supporting frame in accordance with embodiments of the present invention.

The embodiment of FIG. 7A differs from the embodiment described in FIG. 2 in that the horizontal beams 1320A may be used to support the display panels 1350. In one embodiment, both horizontal beams 1320A and vertical beams 1320B may be used to support the display panels 1350. In another embodiment, horizontal beams 1320A may be used to support the display panels 1350 but the vertical beams 1320B may be used to reinforce the frame structure rather than directly support the display panels 1350.

FIG. 7B illustrates an alternative embodiment including additional beams 1320C, which may be narrower than the other beams of the frame. One or more of the thinner beams 1320C may be placed between the regular sized vertical beams 1320B.

FIG. 7C illustrates a further embodiment illustrating both a top view, bottom view and side view of a frame. The frame 20 may be attached to a wall or other structure using plates 35. The frame 20 may comprise a plurality of vertical beams and horizontal beams. In one embodiment, the frame 20 comprises an outer frame having a top bar, a bottom bar, a left bar and a right bar. A display panel 1350 may be supported between two adjacent beams marked as L3 beams, which may be thinner (smaller diameter) and lighter than the thicker and heavier load bearing beams 131 marked as L2 beams used for forming the outer frame. As an illustration, the L2 beams may be 4" while the L3 beams may be 3" in one example.

Figure 8:
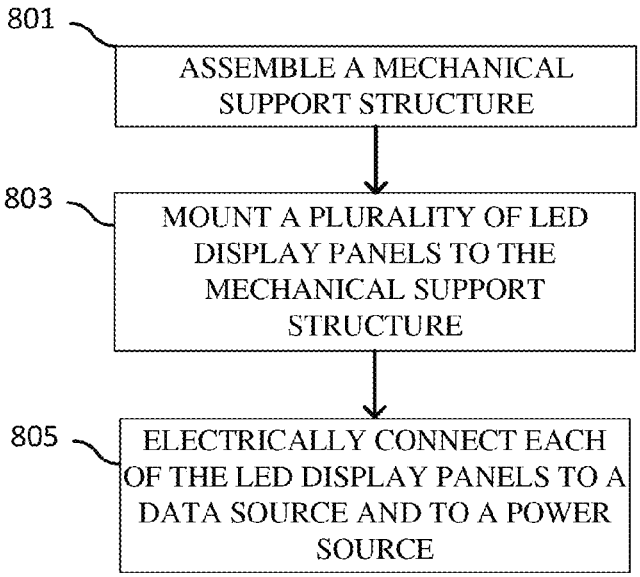
FIG. 8 illustrates a method of assembling a modular multi-panel display system in accordance with an embodiment of the present invention.

FIG. 8 illustrates a method of assembling a modular multi-panel display system in accordance with an embodiment of the present invention.

A mechanical support structure such as the frame 20 described above is assembled taking into account various parameters such as the size and weight of the multi-panel display, location and zoning requirements, and others (box 801). For example, as previously described, the mechanical support structure includes a plurality of vertical bars and horizontal bars. The mechanical support structure may be fabricated from a corrosion resistant material in one or more embodiments. For example, the mechanical support structure may be coated with a weather-proofing coating that prevents the underlying substrate from corroding. If a catwalk is needed, for example, the frame may include such a structure.

A plurality of LED display panels are mounted on to the mechanical support structure so as to form an integrated display panel that includes an array of rows and columns of LED display panels as described in various embodiments (box 803). Each of the LED display panels is hermetically sealed. Mounting the LED display panels may comprise mounting each LED display panel to a respective vertical beam using an attachment plate.

Each of the LED display panels is electrically connected to a data source and to a power source (box 805). For example, a first LED display panel in each row is electrically coupled to the display source. The other LED display panels in each row may be daisy-chain coupled to an adjacent LED display panel.

Figure 9:
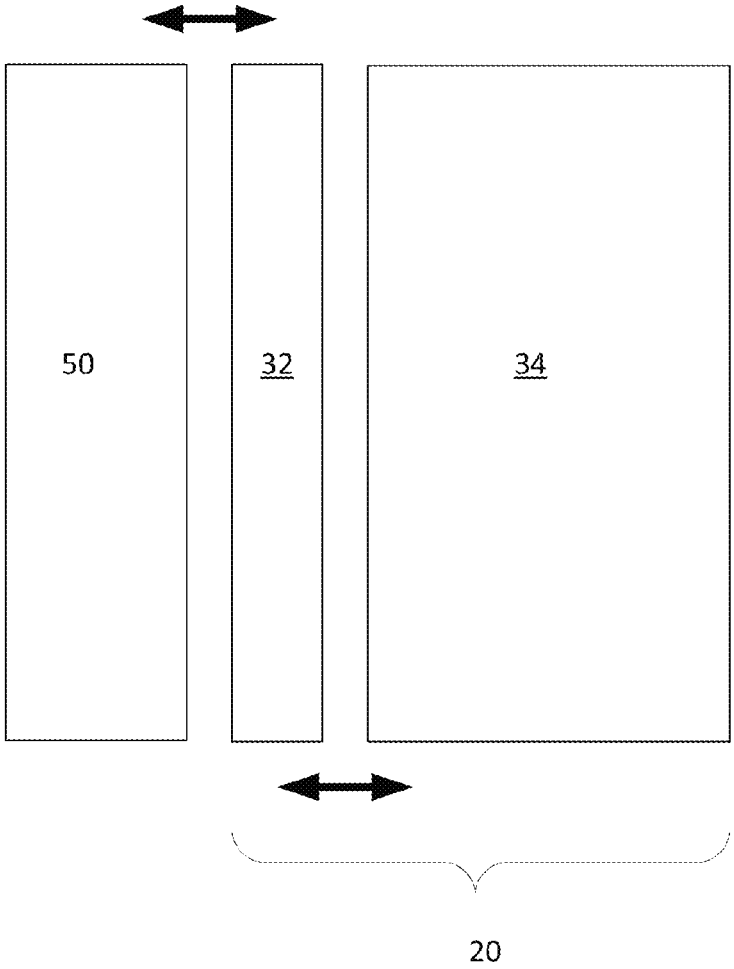
FIG. 9 illustrates a method of assembling a modular multi-panel display in accordance with an embodiment of the present invention.

FIG. 9 illustrates a method of assembling a modular multi-panel display in accordance with an embodiment of the present invention.

In one embodiment, referring to FIG. 9, the display panels 50 may be coupled (arrows) to vertical beams 32 using connecting plates 30 as illustrated in FIG. 2. The cage 34 is then attached (arrows) to the vertical beams 32 using another set of connecting plates.

Since the assembled display structure is light weight, significant assembly advantages can be achieved. For example, the panels can be assembled within a warehouse that is remote from the final location where the display will be utilized. In other words, the panels can be assembled at a first location, shipped to a second location and finalized at the second location.

Figure 10:
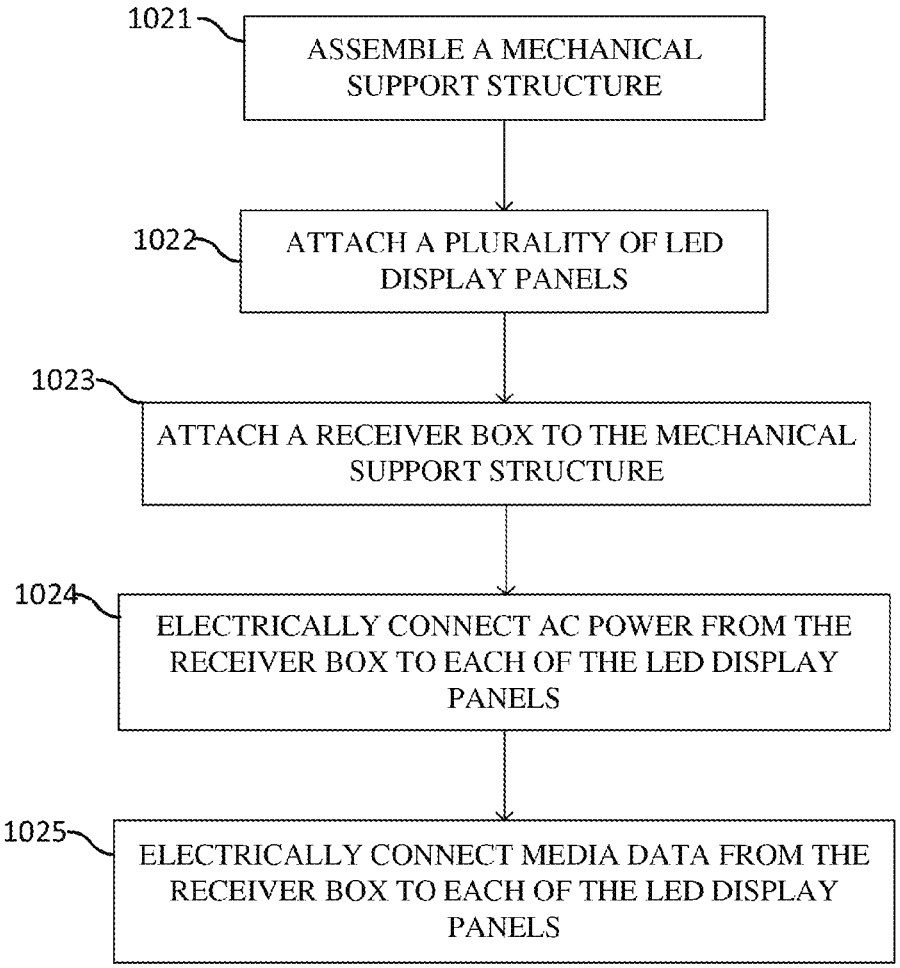
FIG. 10 illustrates a method of assembling a modular multi-panel display in accordance with an embodiment of the present invention.

FIG. 10 illustrates a method of forming a preassembled modular multi-panel display in accordance with an embodiment of the present invention.

Referring to FIG. 10, a mechanical support structure such as a frame is assembled as described above in various embodiments (box 1021). A plurality of LED display panels is attached directly to the mechanical support structure using a plurality of coupling mechanisms (box 1022). The coupling mechanisms may include additional structures such as connecting plates, for example.

A receiver box is attached to the mechanical support structure (box 1023). In one embodiment, the receiver box includes power circuitry with an ac power input and an ac power output. The receiver box further includes digital circuitry configured to process media data to be displayed by the LED display panels. AC power from the receiver box is electrically connected to each of the LED display panels (box 1024). Media data from the receiver box is electrically connected to each of the LED display panels (box 1025). For example, a plurality of integrated data and power cables are interconnected.

Embodiments of the present invention will now be described to illustrate installation of the preassembled display panel system at an on-site location.

FIGS. 11A-11D illustrate an embodiment of the present invention for forming a large display panel by installing a plurality of preassembled display units or display sections.

In various embodiments, the preassembled display units 10 may be at least 12 ft×24 ft, i.e., which is 12 ft tall and 24 ft wide. Other common sizes for the preassembled display units 10 may comport to the standard billboard sizes used in the country of installation such as, for example, 6 ft×12 ft, 12 ft×25 ft, 10.5 ft×36 ft, 12 ft×40 ft, 14 ft×48 ft, 16 ft×60 ft, 20 ft×50 ft, and 20 ft×60 ft.

In one or more embodiments, the very large display panel may be formed by joining together a plurality of preassembled display units 10. For example, the largest size of the preassembled display units 10 may be limited by the size permitted for safe transportation in a rail car or truck or that is needed for the particular application. As such, the preassembled display units 10 may not be larger than the maximum size allowed for transportation in a truck, which may be governed by local laws as well as practical limitations.

Each plurality of preassembled display units 10 may include one or more ladders 145 and one or more catwalks 140 for accessing the individual display panels conveniently. Further, the plurality of preassembled display units 10 may include doors 146L, 146R, which may be removed during the installation so as to form a continuous catwalk 140 from one display unit to another after the installation is completed. Alternatively, the doors may be opened as needed during operation of the display system by servicing personnel.

In various embodiments, the plurality of preassembled display units 10 includes the display panels and the receiver boxes mounted onto the frame. In some embodiments, each of the plurality of preassembled display units 10 may include completed electrical connections between the display panels and the receiver boxes.

In various embodiments, the plurality of preassembled display units 10 may be designed to accommodate specific features of the mounting wall or mounting billboard pillar. For example, mounting on to a historic building may require specific compliance with various rules with regard to the load bearing mechanical design, electrical design, appearance, and others. As the display system is factory assembled, these rules may be easily taken into account when designing and building the preassembled display unit.

Figure 11A:
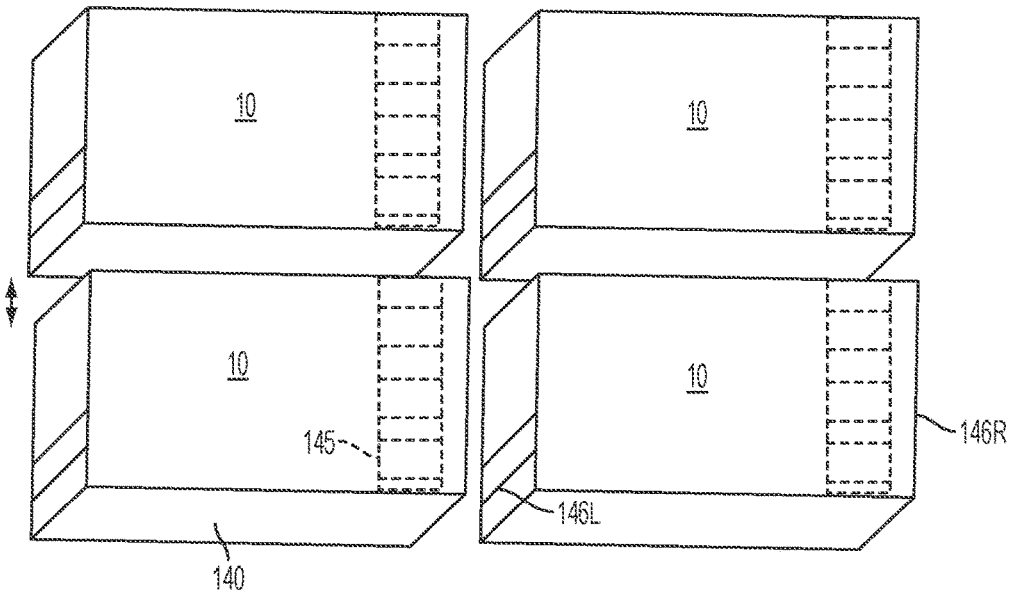

If the final size of the display panel is larger than the largest size of the preassembled display panel, a simple on-site installation may be performed to mechanically connect the individual plurality of preassembled display units 10 (shown by the arrows in FIG. 11A). For example, each of the plurality of preassembled display units 10 may include mechanical features so as to align and/or mechanically support the plurality of preassembled display units 10 stacked above. However, in various embodiments, the preassembled display unit 10 comprising the frame and a plurality of display panels are lifted and mounted together as one unit and stacked with other similar preassembled units.

Figure 11B:
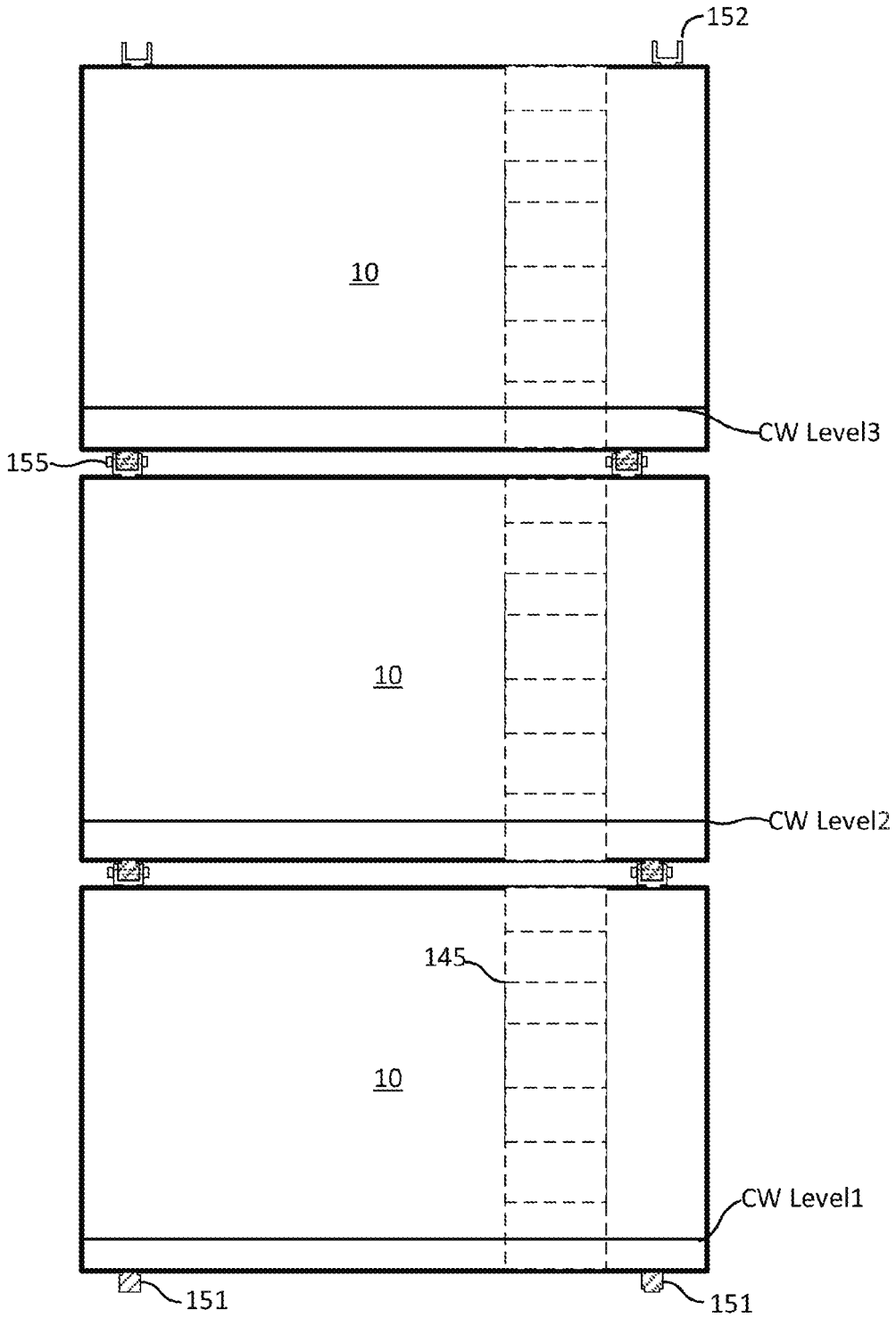

FIG. 11B illustrates one example embodiment of the mechanical features used to align and/or mechanically support the plurality of preassembled display units.

Referring to FIG. 11B, each of the preassembled display units 10 may include a ladder 145, which when aligned correctly forms a continuous vertical pathway to access various levels of the catwalk represented as CW Level 1, CW Level 2, CW Level 3. A good alignment of the preassembled display units 10 is necessary to provide an appealing visual effect as well as to align the ladders 145 and the catwalk 140 in the adjacent preassembled display units 10. Accordingly, alignment features are provided, which may be used to align as well as to mechanically support the preassembled display units 10. For example, the alignment feature may be a telescopic joint, a slip joint, a ball and socket joint in various embodiments.

FIG. 11B illustrates a joint having a first joining feature 151, which may comprise a solid inner barrel or a hollow tube and a second joining feature 152, which may comprise a concentric barrel feature configured to receive the solid inner barrel or a hollow tube of the first joining feature 151. The second joining feature 152 may be a square pipe in one embodiment while the first joining feature 151 may be a solid square block, or even a square pipe in another embodiment. The first joining feature 151 has a smaller outer dimension than the second joining feature 152 so that it can slide into the second joining feature 152 in various embodiments.

One of the preassembled display units 10 may be positioned over another preassembled display unit 10, and the first joining feature 151 inserted into the second joining feature 152. The joint may be secured using screw or bolts 155, for example. The preassembled display units 10 may comprise additional features such as leveling planes to ensure proper horizontal alignment.

The preassembled display units 10 are thus assembled to form one large display. Advantageously, in various embodiments, the installation of such a large panel can be accomplished in relatively short time duration without expending on-site labor. For example, on-site installation of a conventional system can be very labor intensive, which increases the cost and poses significant risk to the installer. As the preassembled panels are finished out in the factory, the on-site installation process is much easier reducing costs significantly.

Figure 11C:
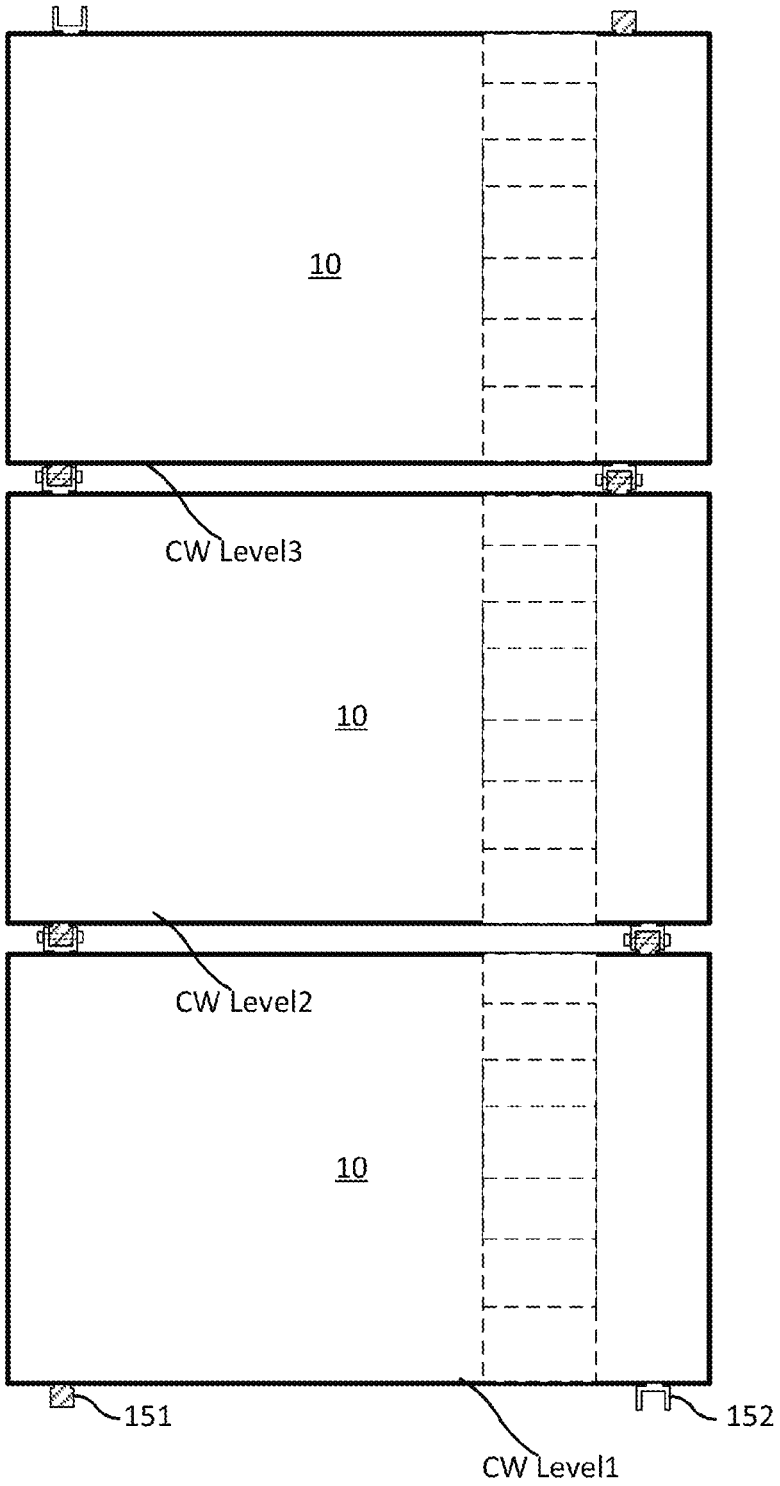

FIG. 11C illustrates another embodiment in which some of the first features and second features may be interchanged to form a tighter fit.

Figure 11D:
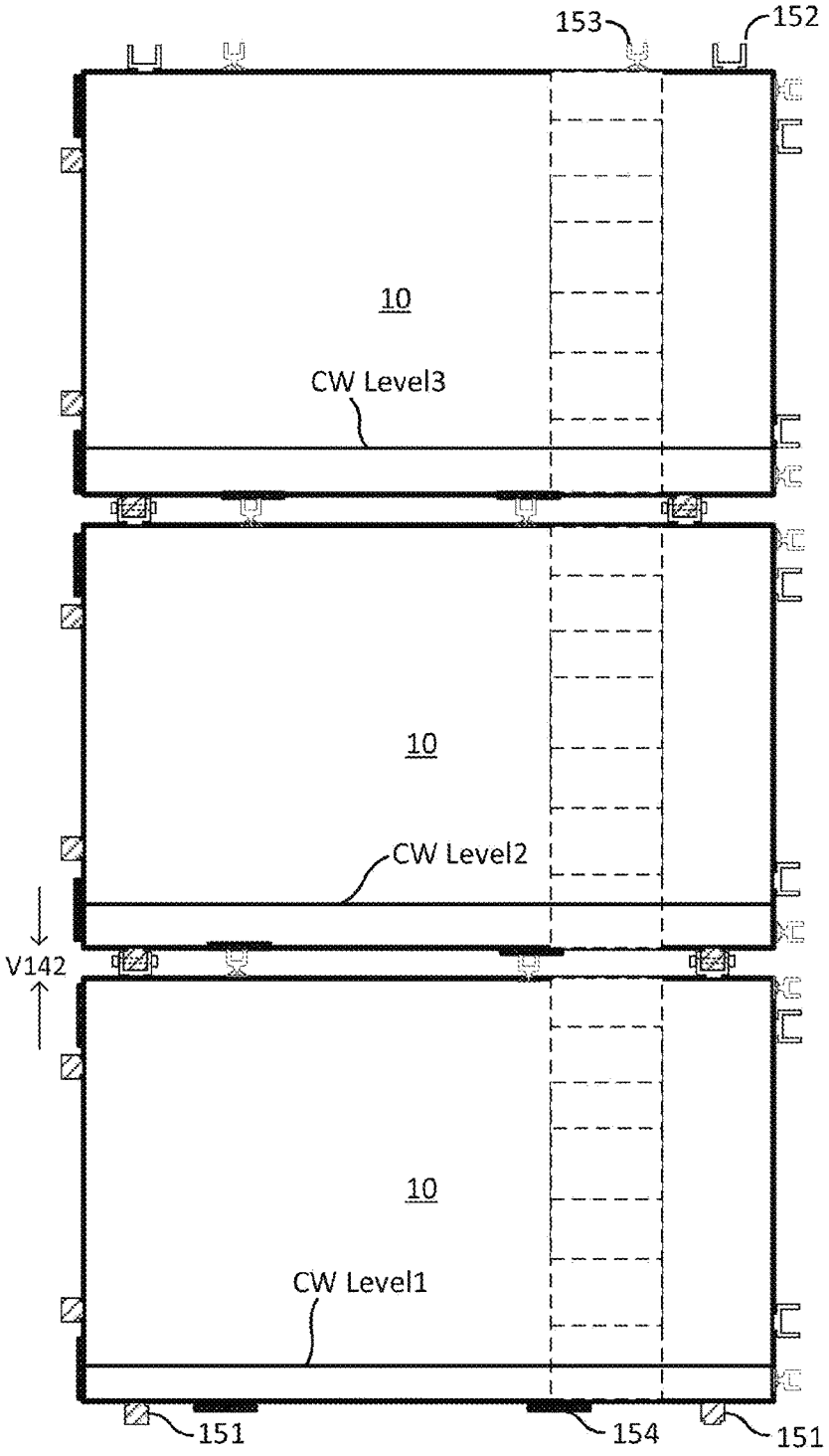

FIG. 11D illustrates a further embodiment showing additional adjustment features for adjusting the vertical and horizontal distances between adjacent preassembled display units. Additionally embodiments of the present invention may include height adjustment features such a jack bolt that may be used to adjust the vertical distance V142 between the adjusted preassembled display units 10. As an example, the height adjustment features may include a jack screw 153 whose height may be adjusted and a platform 154. In various embodiments, the vertical distance V142 between the adjusted preassembled display units 10 is about the same to the vertical distance between adjacent display panels of the plurality of display panels 50 within each preassembled display unit 10. Therefore, once the preassembled display units 10 are stacked together, the separation between the adjacent preassembled display units 10 is visually indistinguishable. Such jacks may be added to the horizontal sides of the chassis 34 as well for the same reason, for example.

Figure 12A:
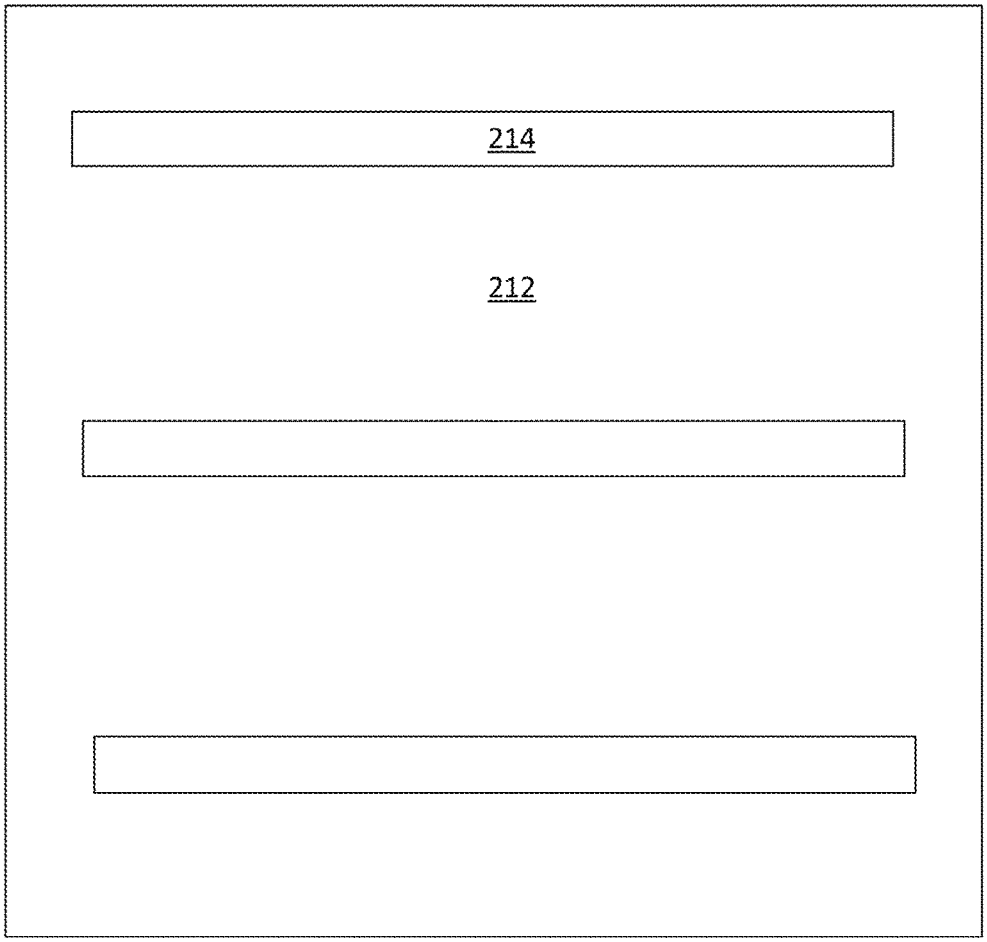
Figure 12B:
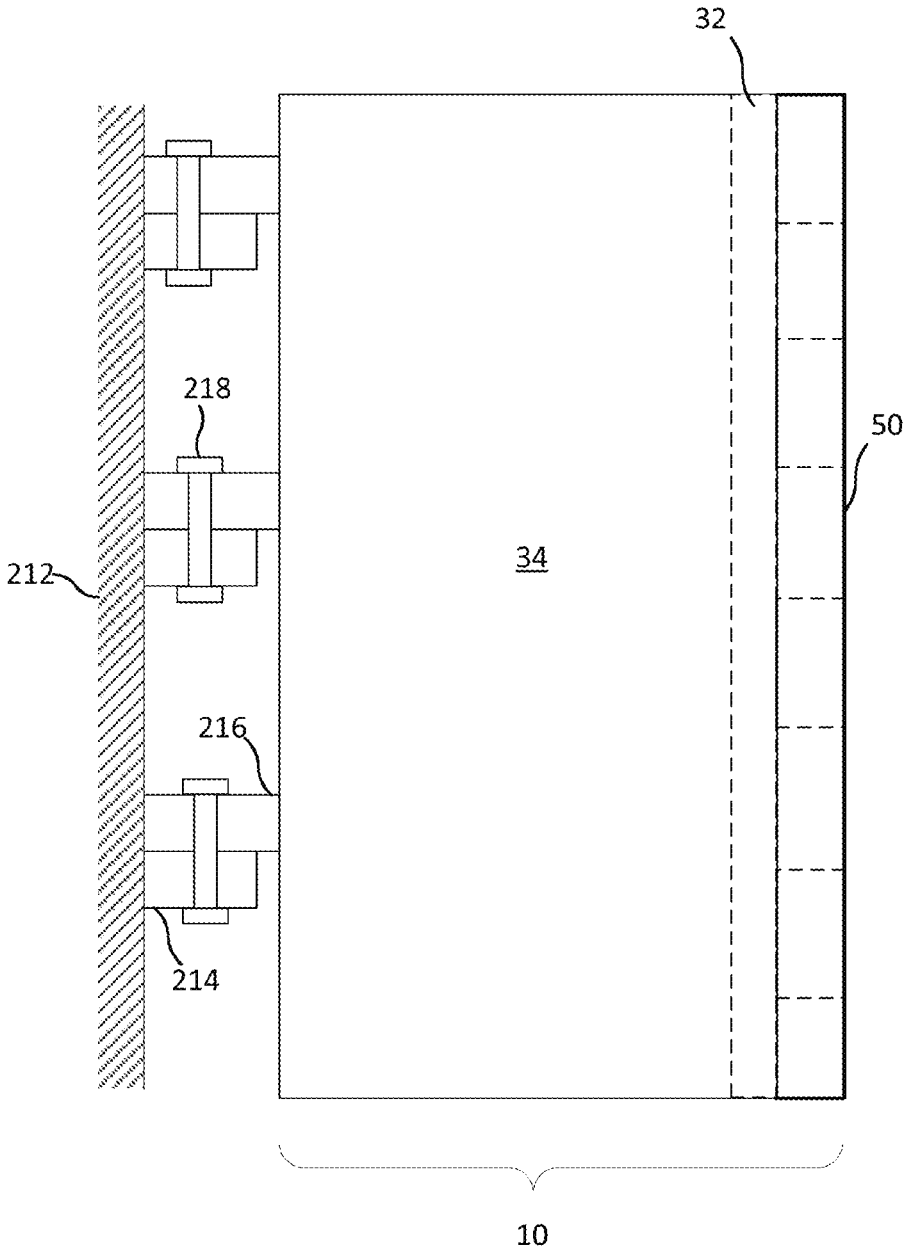
Figure 12C:
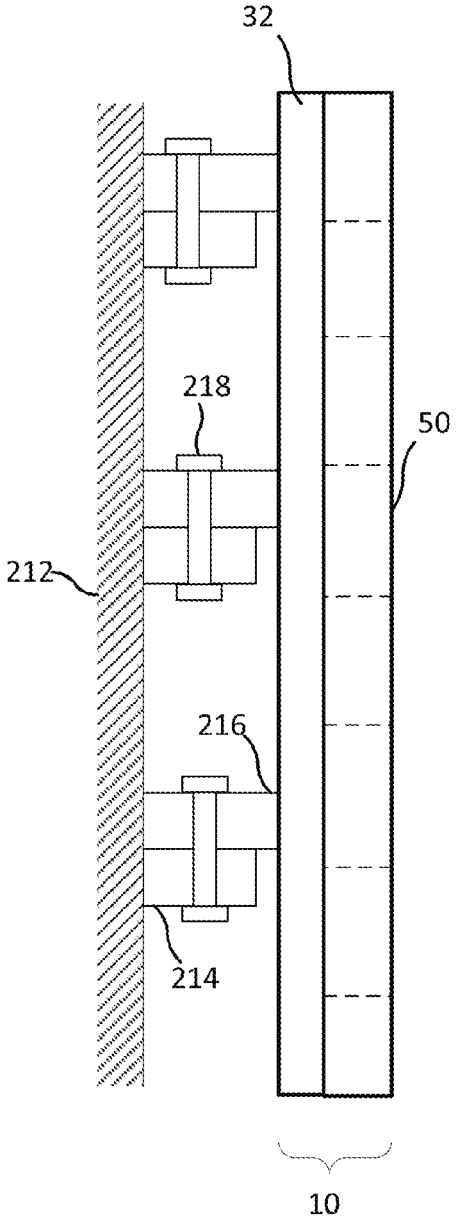

FIGS. 12A-12C illustrate an on-site wall mounting of a preassembled display unit in accordance with an embodiment of the present invention. FIG. 12A illustrates a front view of the mounting wall and FIGS. 12B and 12C illustrate side views illustrating the mounting wall and the mounted preassembled display unit.

Referring now to FIG. 12A, the mounting wall 212 may be a feature attached to a building or other surface on which the display unit is to be finished. The mounting wall 212 may be installed first in anticipation of the subsequent installation of preassembled display unit. The mounting wall 212 includes one or more mounting points 214 or stringers. The mounting points 214 may be attached to the mounting wall 212 if necessary at the time of the installation.

Referring to FIG. 12B, in one embodiment, the preassembled mounting display unit 10 includes a cage 34 with vertical beams 32 on which the plurality of display panels 50 are mounted. The preassembled mounting display unit 10 is mounted onto the mounting wall 212 as illustrated in FIG. 12B. In one embodiment, the preassembled mounting display unit 10 is positioned so that the mounting fixtures 216 of the preassembled mounting display unit 10 are mechanically supported by the mounting points 214 or stringers. After correctly aligning the mounting fixtures 216 with the mounting points 214, anchors 218 may be used to permanently secure the mounting fixtures 216 to the mounting points 214.

FIG. 12C illustrates a further embodiment in which the plurality of beams is directly mounted to the mounting wall. In this embodiment, a catwalk and the accompanying chassis may be skipped and the preassembled mounting display unit 10 comprising the vertical beams 32 may be directly mounted onto the mounting wall 212.

Figure 13A:
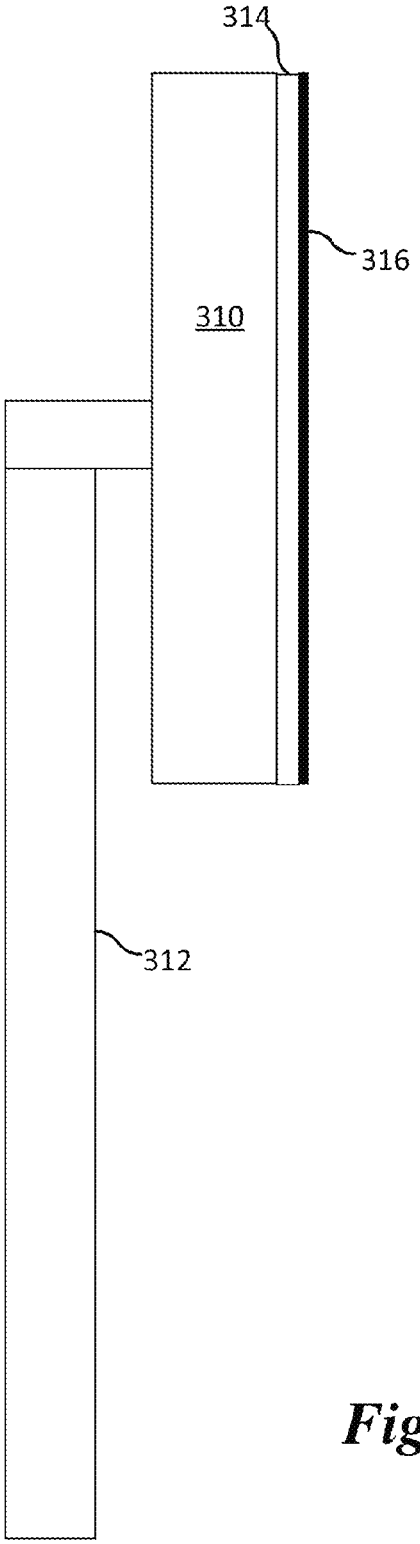
FIGS. 13A and 13B illustrate a method of retrofitting a preexisting billboard in accordance with an embodiment of the present invention.
Figure 13B:
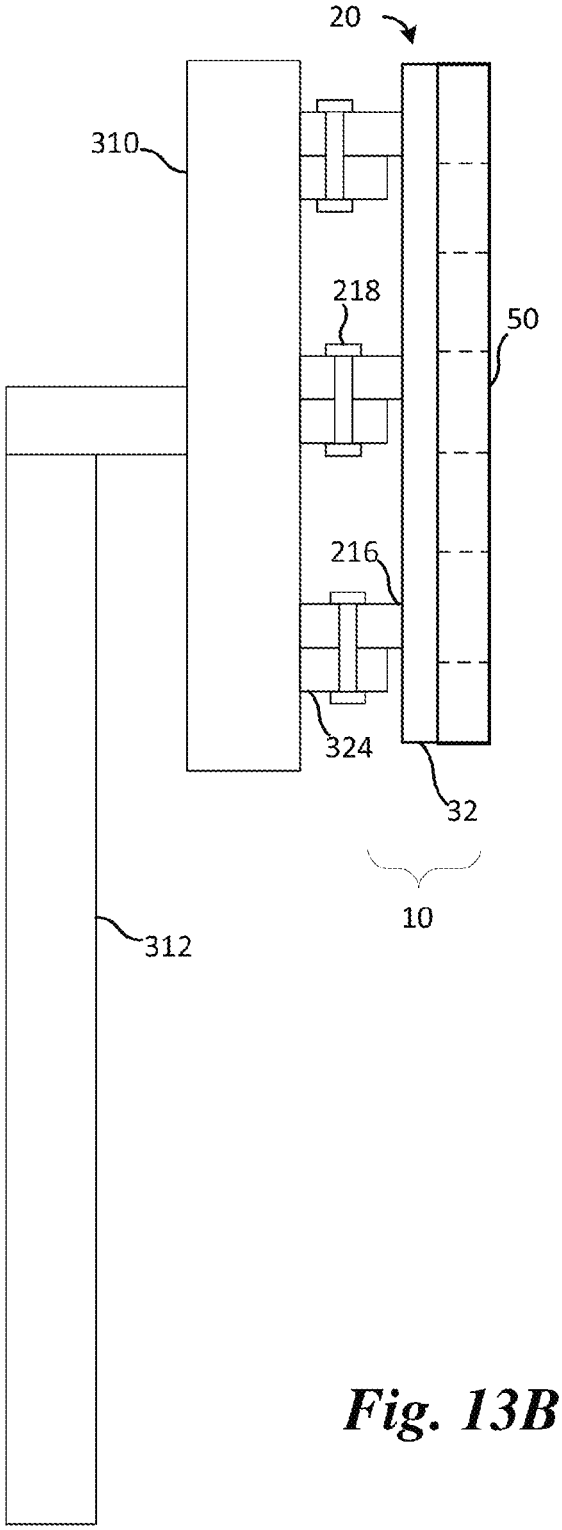

FIGS. 13A and 13B illustrate a method of retrofitting a preexisting billboard in accordance with an embodiment of the present invention.

In various embodiments, preexisting displays, such as a billboard, may be removed and fitted with one or more of the preassembled display units. The preexisting billboard to be retrofitted may be a non-electronic billboard and may also include mercury or fluorescent lighting. Embodiments of the present invention may be applied to different types of billboards including wooden billboards with wooden supports with dimensional lumber as the secondary support (A frame). Embodiments may be applied to retrofit a preexisting steel A-frame billboard comprising angle iron or steel supports with metal framing. In one or more embodiments, a preexisting billboard may include a steel pole with an I-beam or equivalent as the primary support. In another embodiment, the preexisting billboard may include tubular steel support of various circumferences and tubular steel framing as examples. The preexisting billboard may also include a catwalk in some embodiments.

Referring to FIG. 13A, a preexisting billboard may include a central pole 312 supporting the billboard. The billboard may include a billboard frame 310, which may be different depending on the type of the billboard. In various embodiments, the billboard frame 310 may include a catwalk.

The billboard may include a solid plywood layer 314 over which a canvas 316 is mounted. The solid plywood layer 314 may have been mounted on the billboard frame 310. The canvas 316 and the solid plywood layer 314 are removed prior to mounting the preassembled display unit 10 in FIG. 13B.

In various embodiments, if the billboard frame 310 is retained, then the preassembled display unit 10 may not need any additional catwalk as the billboard frame 310 already includes a catwalk. In such embodiments, the preassembled display unit 10 includes only a frame 20 (without the chassis) on which the plurality of display panels 50 have been mounted. Embodiments of the present invention may be applied to billboards of different configurations such as single face, back-to-back, or V-build, side-by-side, stacked, and tri-build configurations.

Referring to FIG. 13B, the preassembled display unit 10 comprising the frame 20 and the display panels 50 is mounted onto the mounting features 324 of the billboard frame 310. If necessary, additional beams such as I-beams may be added to form stringers. Advantageously, the preassembled display unit 10 is mounted quickly without extensive labor because of the modular nature of the preassembled display unit 10, which only requires mechanically hoisting the preassembled display unit 10 and properly aligning the preassembled display unit 10 with the mechanical mounting features 324 of the preexisting billboard frame 310. The installation is completed by mechanically securing the preassembled display unit 10, e.g., using screws or anchors 218, to the preexisting billboard frame 310.

Figure 13C:
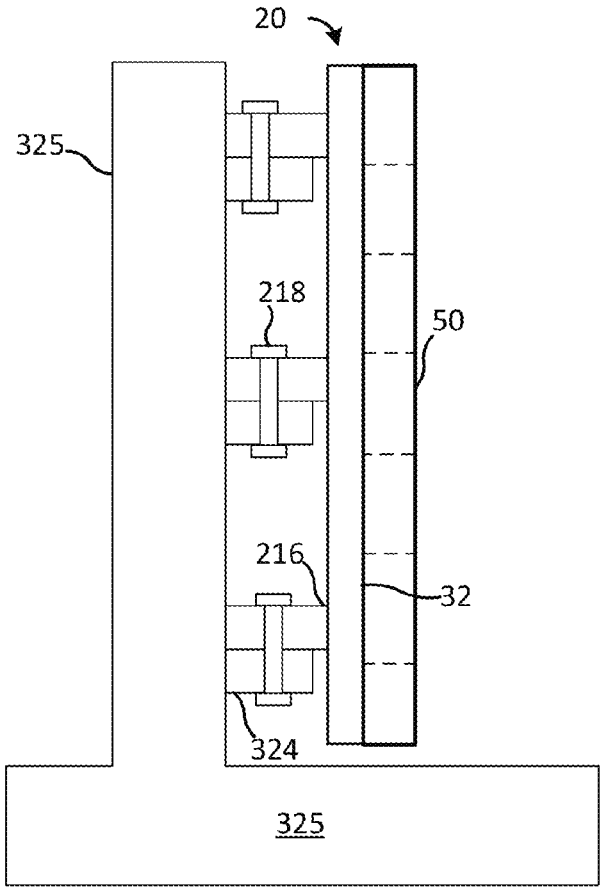
FIG. 13C illustrates an alternative embodiment of the present invention showing a stand mount.

FIG. 13C illustrates an alternative embodiment of the present invention showing a stand mount. In this embodiment, because of the light weight of the preassembled display unit 10, the preassembled display unit 10 may be mounted on a stand mount 325, for example, to be displayed from a shop window. The actual mounting positions and mechanism may be suitably adjusted according to the need (e.g., display aesthetics), the number of display units, and others.

After the mechanical connection is completed, the electrical connection is made. However, in some embodiments, the only electrical connection to be made is the connection of the main power and data cable (if any) to the receiver box. This is because all the connections between the different panels and the receiver box may have been preassembled at the factory before the preassembled display unit 10 was shipped to the site of the billboard. In other embodiments, the receiver box is connected to the input cable of each of the plurality of display units. For example, the receiver box is connected to the first display unit and the remaining display units in the same row are daisy chain coupled. However, in both embodiments, the receiver box may already be mechanically secured while building the preassembled display unit.

Further, because of the lower power consumed by the preassembled display unit, only a single phase power is needed advantageously even for very large displays. Conventionally, three phase power is needed for large display because of the large power consumed by such units.

Figure 14A:
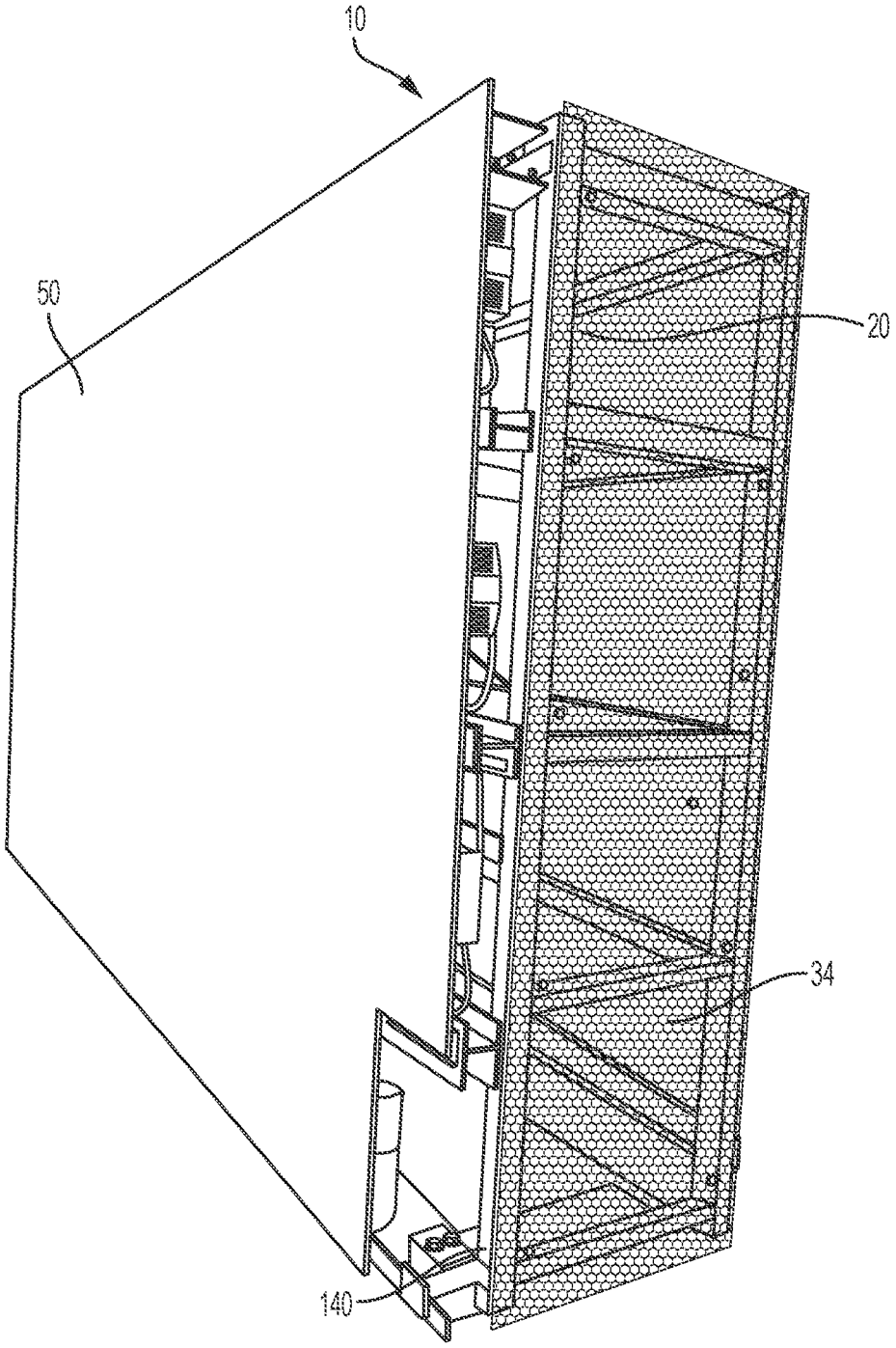

FIGS. 14A-14G illustrate specific examples of a preassembled display unit 10 including the frame 20. As shown in FIG. 14A, the modular preassembled display unit 10 includes a number of LED display panels 50 mounted to frame 20. One of the display panels has been removed in the lower corner to illustrate the modular nature of the display. As a consequence, and additionally, the easy access to the LED display panels 50 from the rear of the preassembled display unit 10 enables hot-swapping. In other words, one or more of the display panels 50 may be removed and replaced without powering down the display system during operation. This enables repair and replacement of any of the display panel without powering down the whole display unit.

Figure 14B:
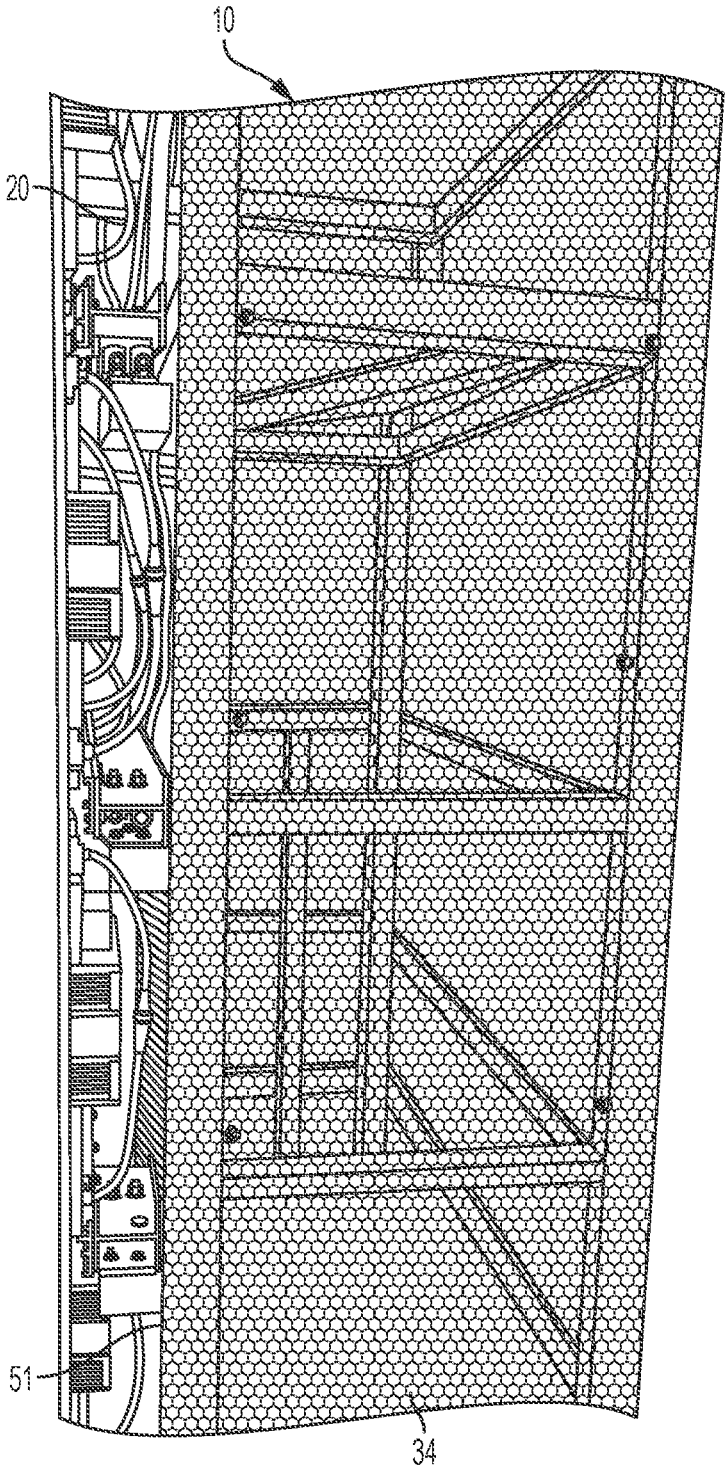
Figure 14C:
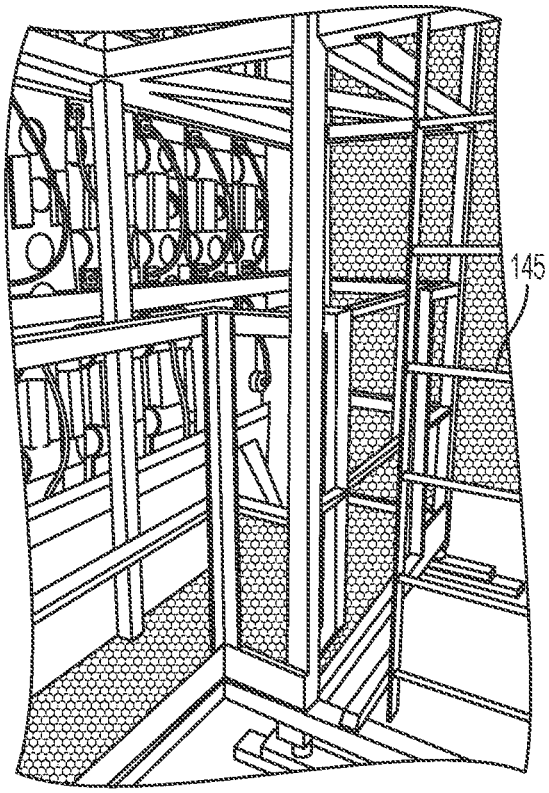
Figure 14D:
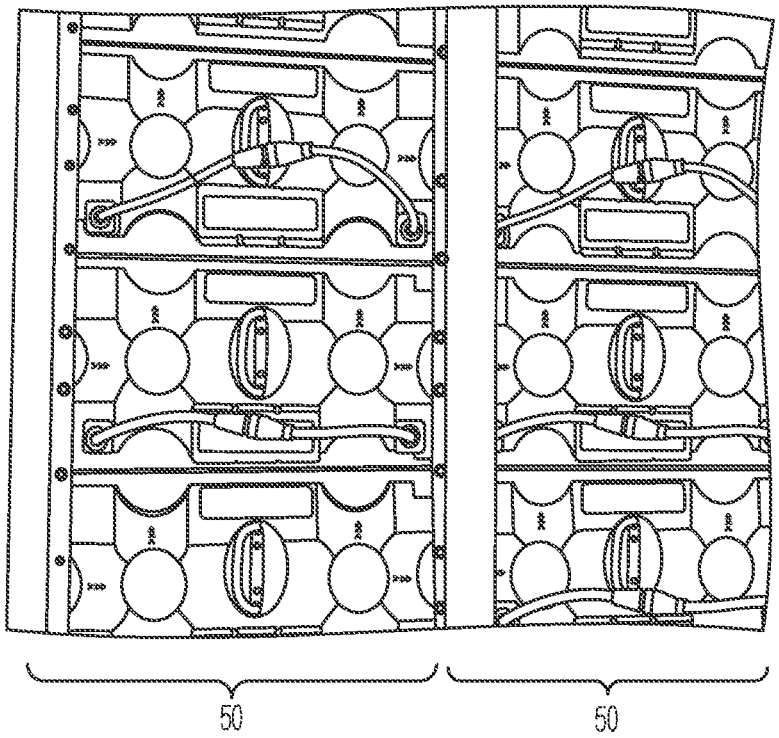

A side view of the display system is shown in FIG. 14B and back views are shown in FIGS. 14C and 14D. FIG. 14B also illustrates the absence of additional protective cabinetry, for example, the back side 51 of the display panels 50 remains exposed.

Figure 14E:
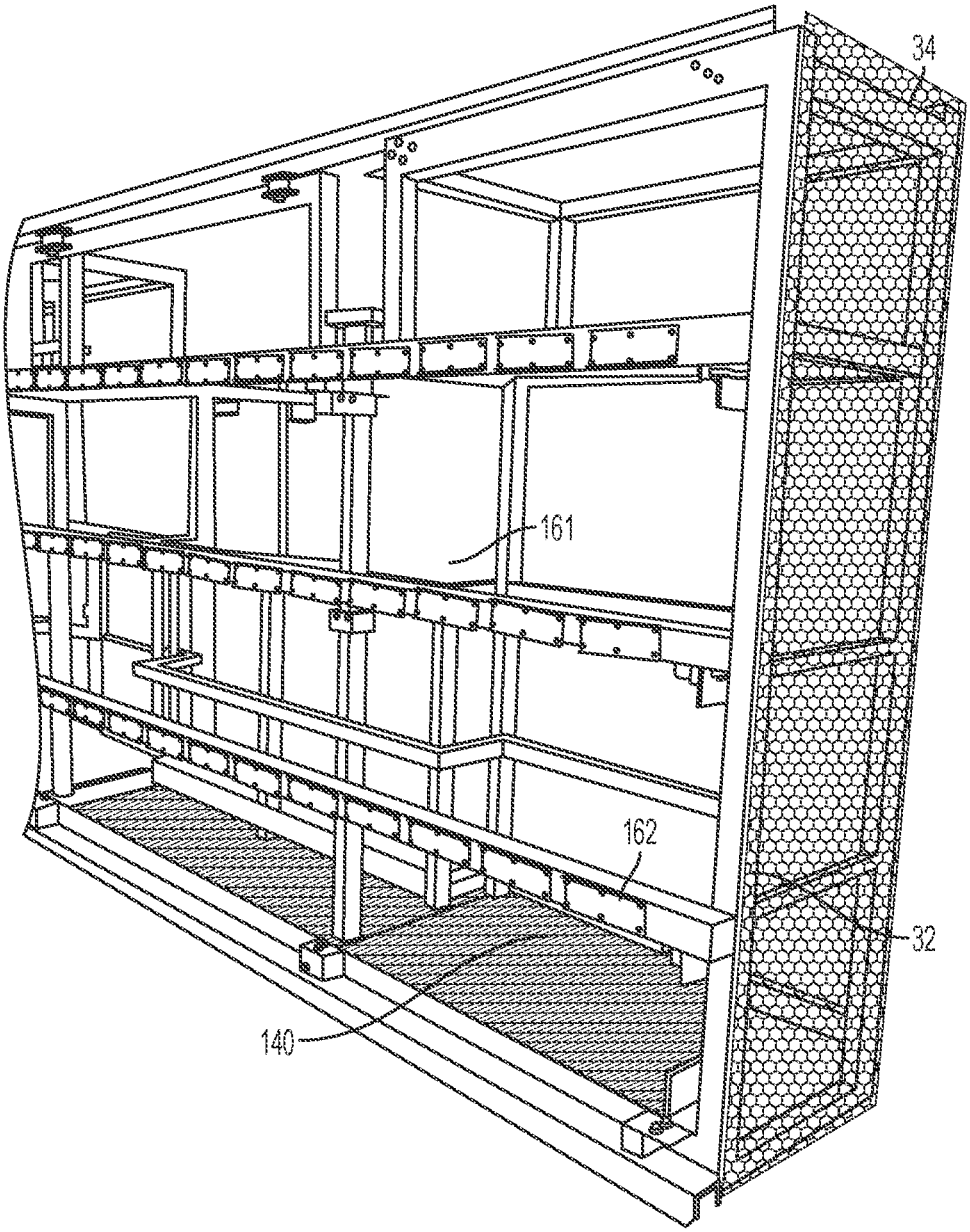
Figure 14F:
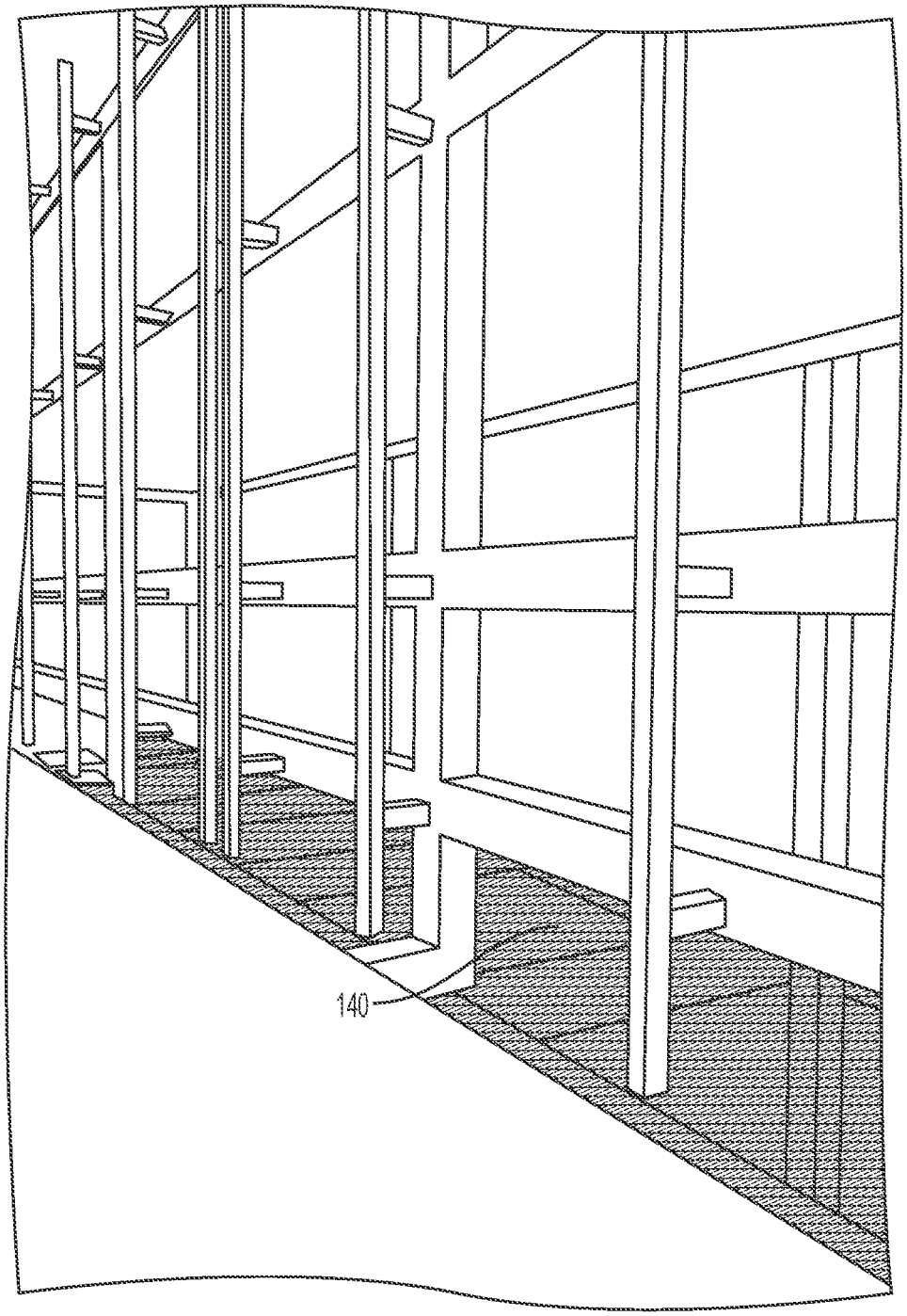
Figure 14G:
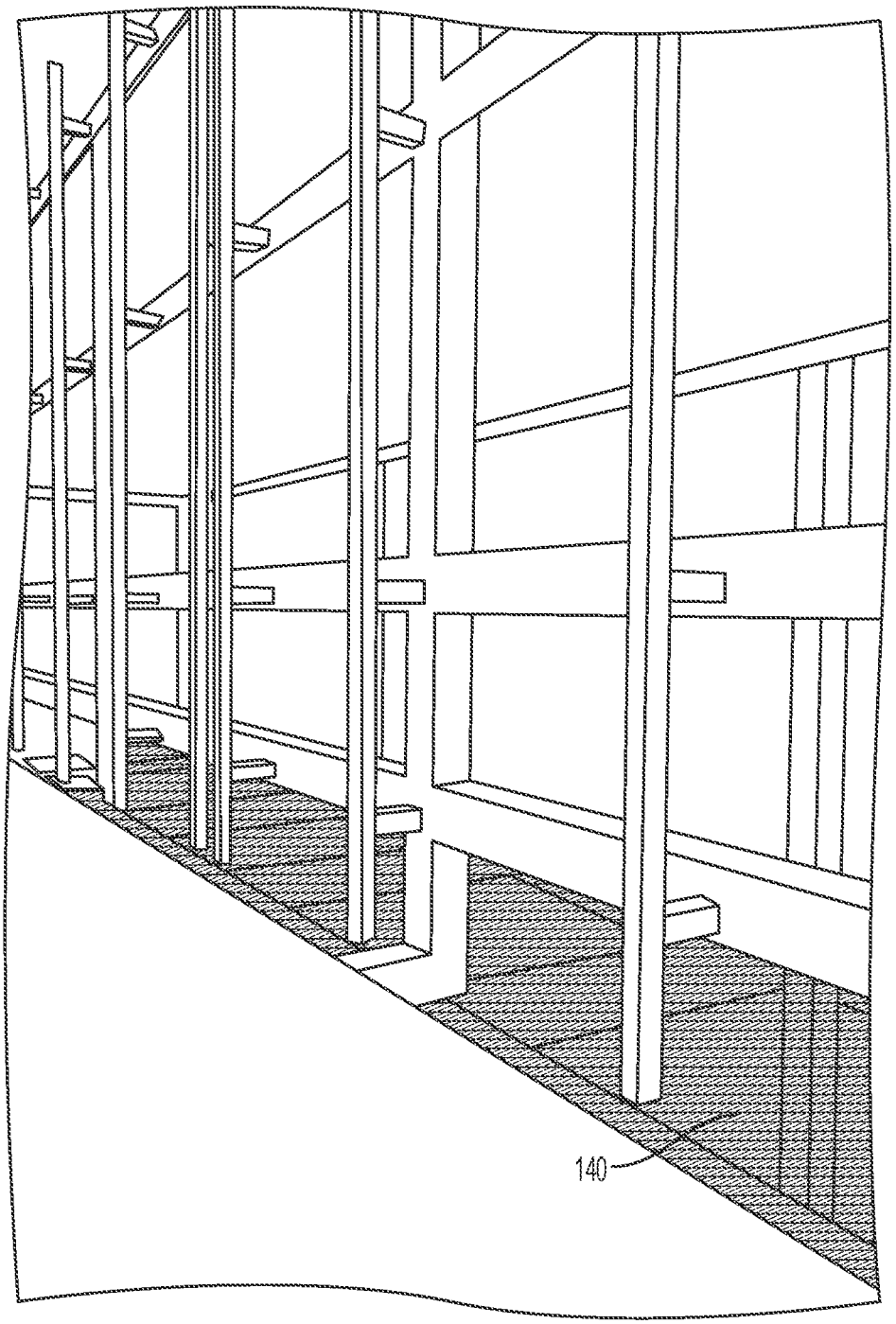

In this particular example, access is provided to the back of the modular display through a cage 34 that includes an enclosed catwalk 140. The catwalk is illustrated in the views without the mounted display panels as illustrated in FIG. 14E-14G. Since the display system 10 is generally highly elevated, a ladder 145 (see FIG. 14C) provides access to the catwalk 140. In the back view of FIG. 14D, the cables of display panels are shown to be locked within itself for safe transportation.

FIG. 14E illustrates the cage 34 without the display panels 50. In this embodiment, the beams of the cage 34 forming an outer frame are bigger than the interior beams. In this case, the interior beams 161 are aligned in a plane outside those of the plurality of beams 32. Upon installation, the plates 162 may be rotated by 90° and fasten to the display panels. Other views of the frame are shown in FIGS. 14F and 14G.

Additionally, in one or more embodiments, the assembled display may have the size of the final on-site display. For example, the assembled display structure at the factory may have the size of a standard billboard (12'×24'). In such embodiments, as described previously, the on-site installation is minimal.

FIGS. 15A-15E illustrates different projection views of a preassembled display system in accordance with an embodiment of the present invention.

Figure 15A:
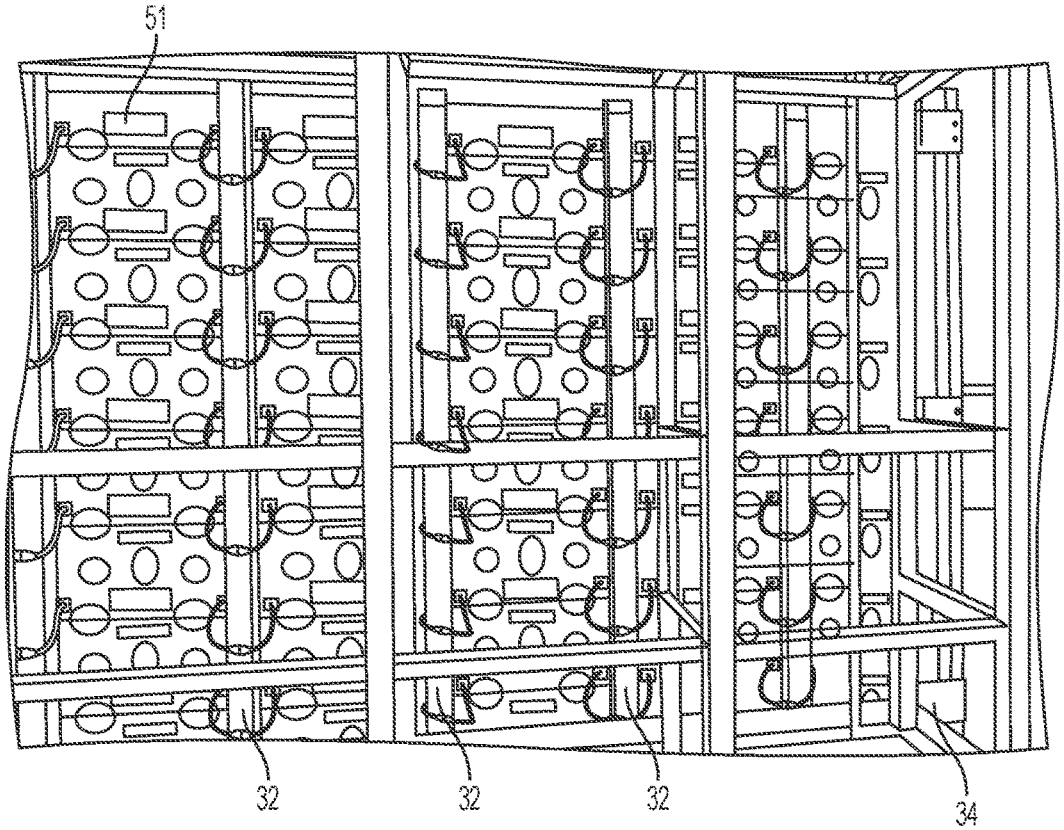

FIG. 15A illustrates a preassembled display system in accordance with an embodiment of the present invention.

The preassembled display system includes a plurality of display panels 50 coupled to the frame 20 that includes vertical beams 32 attached to a cage 34. As in prior examples, the back side 51 of the display panels 50 remains exposed. Similarly, as previously discussed, for each row, a display panel 50 at a first end receives an input data connection from a data source and has an output data connection to a next display panel in the row.

Figure 15B:
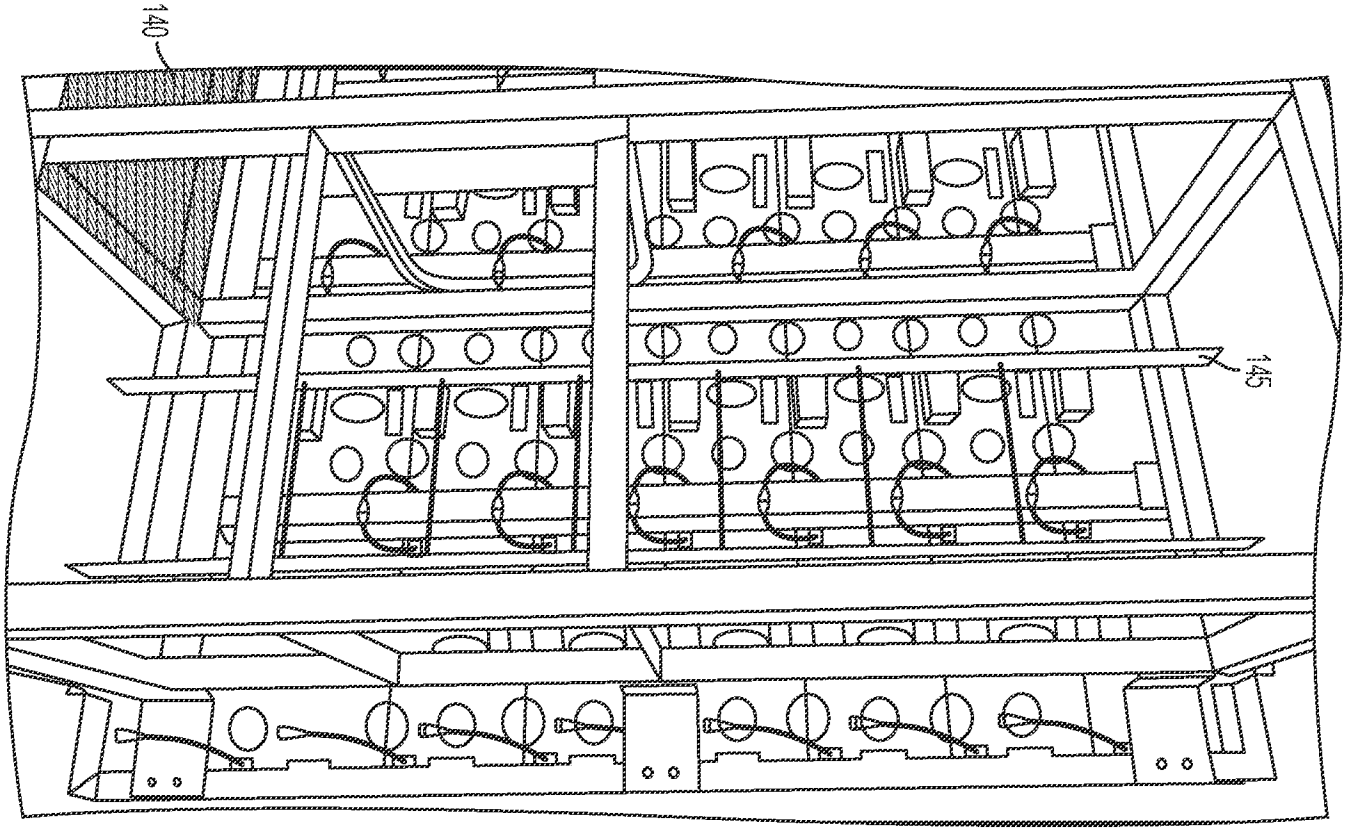

The backside 51 of the display system is accessible from the backside of the display panels 50 from the cage 34, which may include a catwalk (shown in other figures, e.g., FIG. 15B). Consequently, replacing one or more display panels 50 after the initial installation is easier. Thus, a defective display panel can be removed completely from the back side 51 of the display system. Advantageously, no additional front side access is necessary. Further, the display panels are cooled efficiently because they are exposed to the atmosphere and not enclosed within a cabinet as in conventional designs.

FIG. 15B illustrates a magnified view of the preassembled display system illustrated in FIG. 15A in accordance with an embodiment of the present invention.

As described previously, a ladder 145 provides easy access to the various levels of the display system. In this illustrated example, the final display system comprises a plurality of preassembled display units stacked over one another. Thus, the ladder 145 provides access to the higher levels.

Figure 15C:
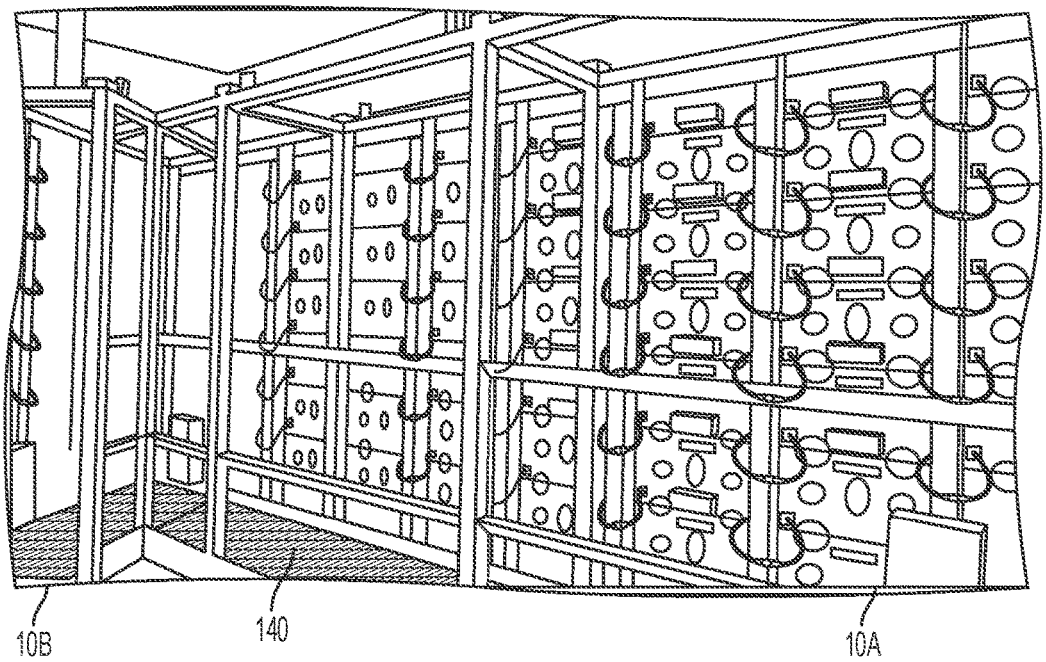

FIG. 15C illustrates a preassembled display system including a non-linear shape in accordance with an embodiment of the present invention.

In various embodiments, the preassembled display system may be constructed according to the design requirements of the mounting wall, for example, shape of the building wall. As illustrated in FIG. 15C, the preassembled display unit 10 includes a first portion 10A and a second portion 10B at an angle with the first portion.

Figure 15D:
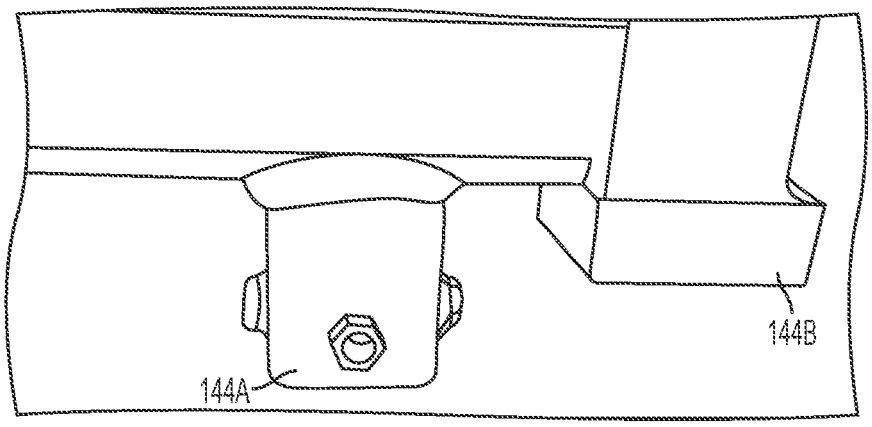

FIG. 15D illustrates a magnified portion of the base of a preassembled display system including a non-linear shape in accordance with an embodiment of the present invention.

In various embodiments, the preassembled display unit 10 may include alignment and mechanical features for stacking preassembled display units 10 over each other. Referring to FIG. 15D, the preassembled display unit 10 includes a first mounting feature 144A and a second mounting feature 144B for attaching to underlying chassis of the underlying preassembled display unit 10. The second mounting feature 144B may be part of an alignment mechanism such as for using a jack bolt and will be described below in subsequent figures.

Figure 15E:
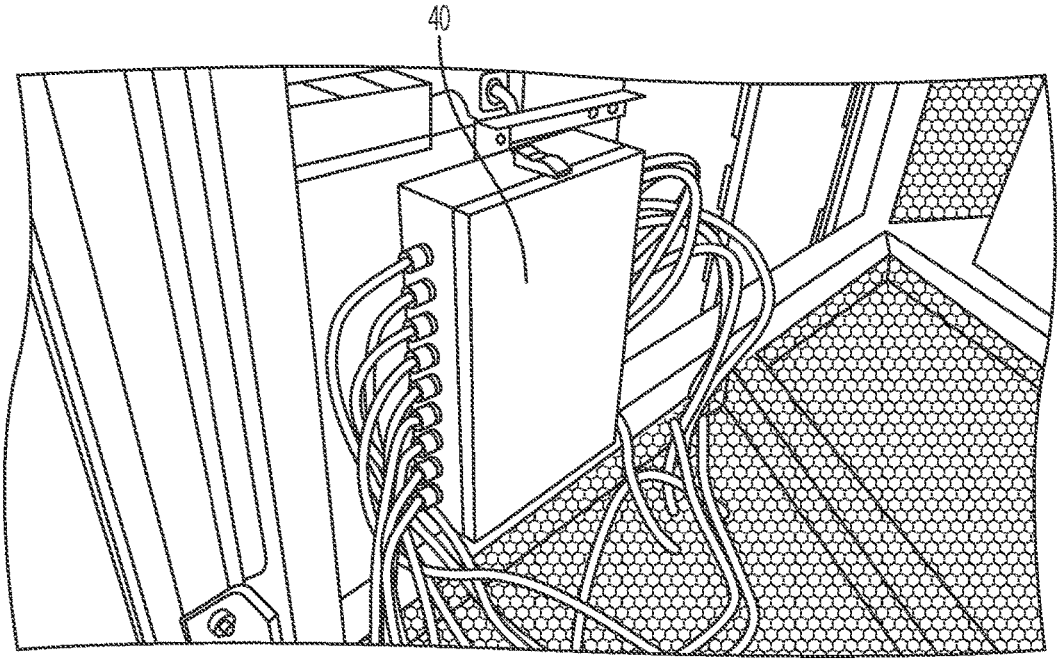

FIG. 15E illustrates a preassembled display unit 10 in which a receiver box 40 is installed. Although the receiver box 40 is installed, it may not be connected to the plurality of display panels. Rather, the cables from the receiver box 40 may be wrapped up for secure transportation. At the installation site, the cables from the receiver box 40 may be connected to cables of the plurality of displays.

Figure 16:
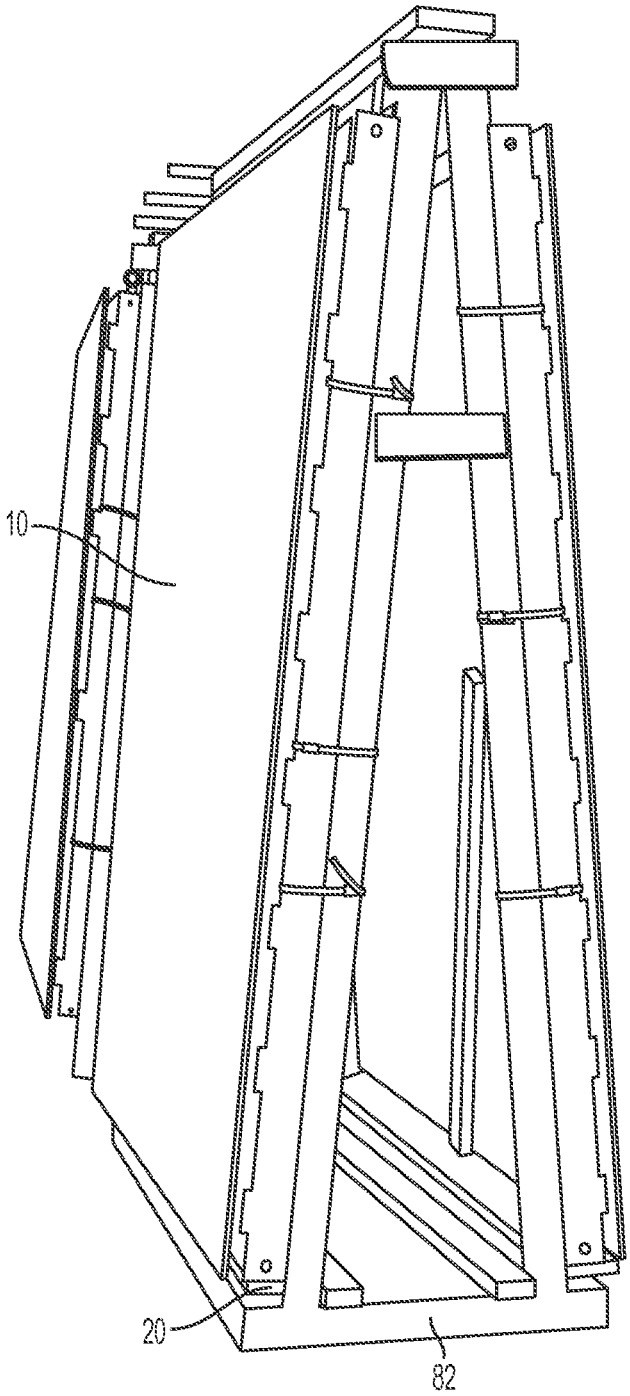
FIG. 16 illustrates an assembled multi-panel display that is ready for shipment.

FIG. 16 is an illustration of two assembled displays that are ready for shipment. In this embodiment, the preassembled display unit 10 may not include a chassis because the display unit is directly mounted on a billboard with a preexisting catwalk. Alternatively, the display unit may be mounted on a stand such as a window stand, e.g., in a window display. These displays can be quite large, for example much larger than a 14×48 panel display. In some cases, a single display system is shipped as a series of sub-assemblies, e.g., as shown in the figure, and then assembled into a full display on location. At the installation site, the preassembled display units 10 may be removed from the shipping mount and raised and mounted onto a mounting wall or window stand.

FIGS. 17A-17F illustrates different projection views of a preassembled display system illustrating the features used for stacking and alignment in accordance with an embodiment of the present invention.

Figure 17A:
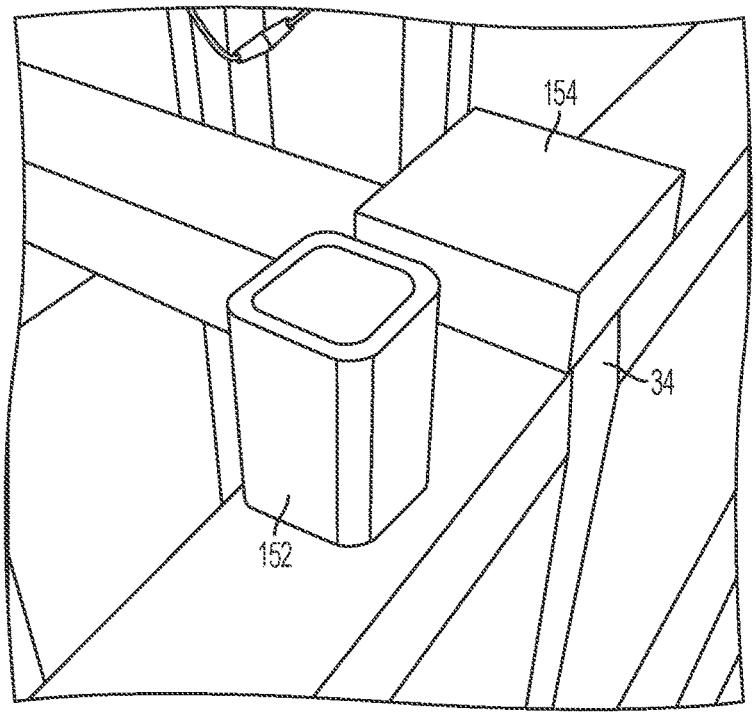

FIG. 17A illustrates a preassembled display system in accordance with an embodiment of the present invention.

As illustrated in FIG. 17A in one illustrated embodiment, one surface of a cage 34 includes a second joining feature 152 and a platform 154. In one embodiment, the second joining feature 152 is a hollow square tube configured to receive another square tube or square block. The platform 154 provides a solid base to receive a head of a jack screw and thus may be used to lower an overlying chassis, which may be mounted subsequently over the illustrated cage 34.

Figure 17B:
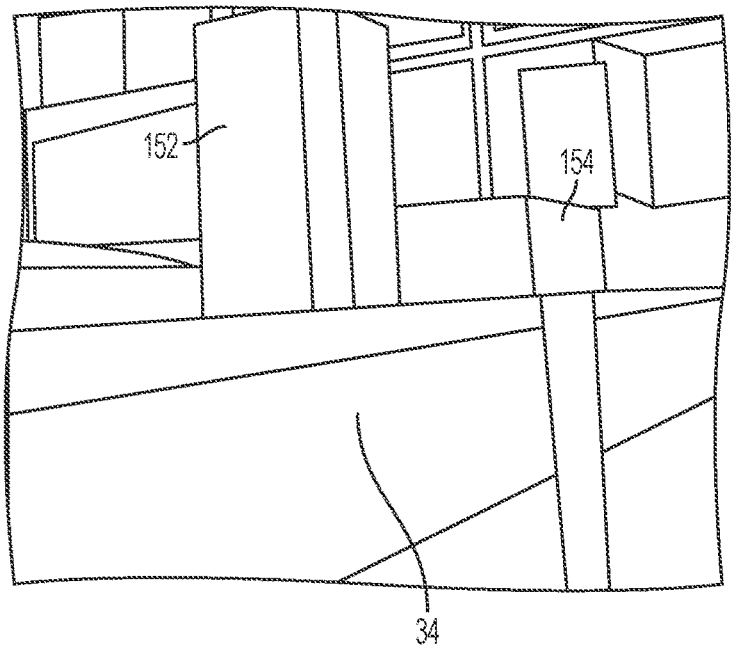
Figure 17C:
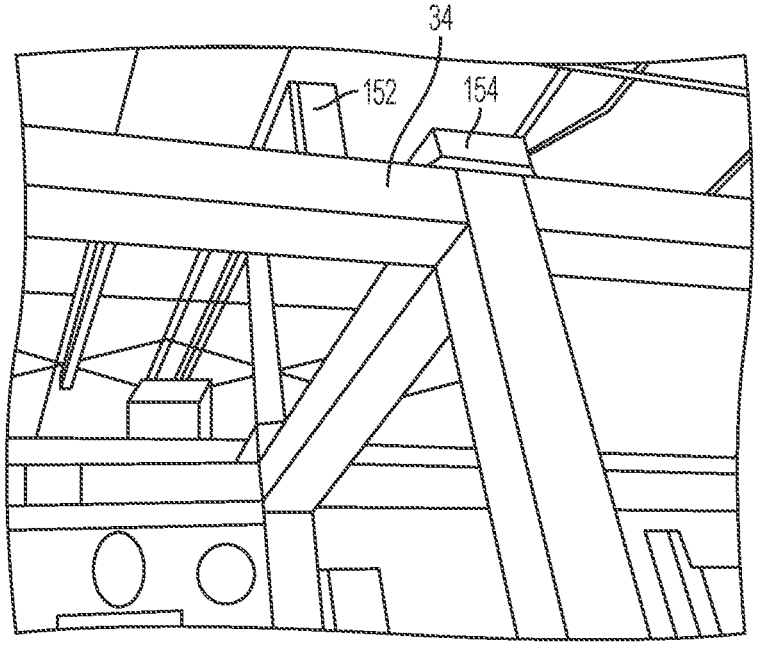

FIG. 17B illustrates another magnified projection view of the cage 34 showing the platform 154 and the second joining feature 152. FIG. 17C illustrates a side projection view of the cage 34 showing the platform 154 and the second joining feature 152.

Figure 17D:
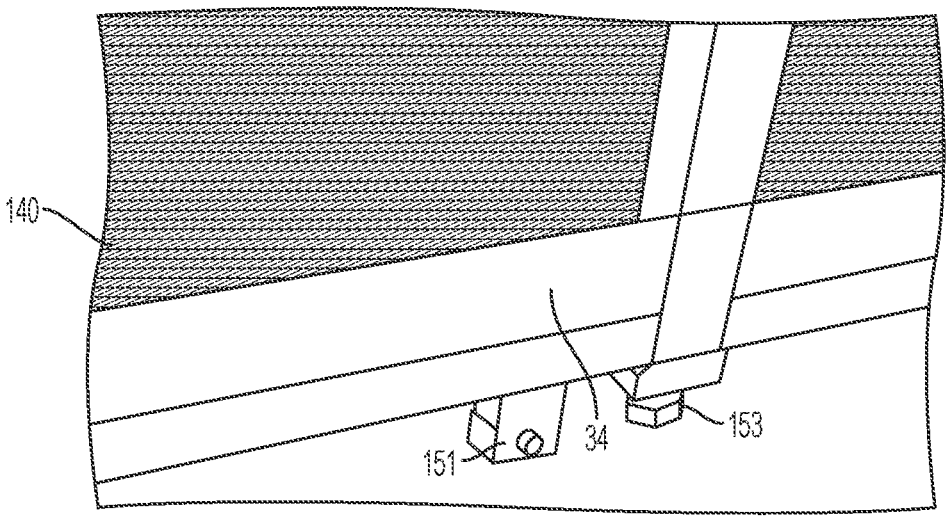

FIG. 17D illustrates a magnified projection view of another side of a cage showing a jack screw and a first joining feature.

As illustrated in FIG. 17D, the other side of the cage may include a first joining feature 151 which may be a solid square block or square tube having a diameter smaller than the second joining feature 152. A jack screw 153 may be used to raise or lower the cage 34.

Figure 17E:
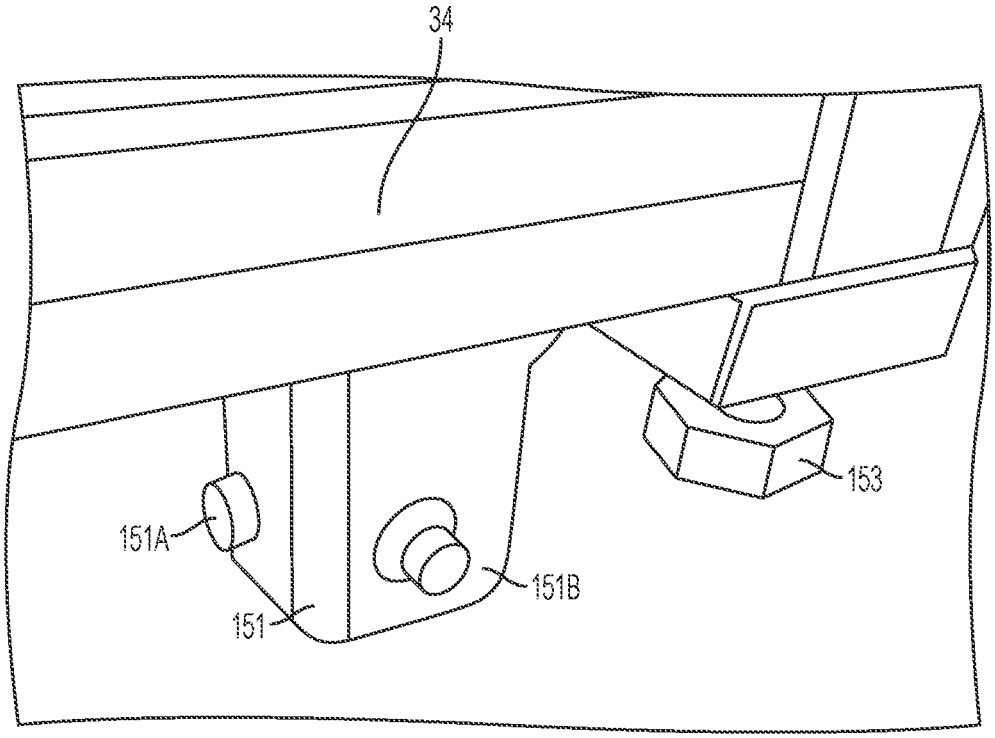

FIG. 17E illustrates another magnified projection view showing the first joining feature 151 and the jack screw 153. Thus, during subsequent installation, the first joining feature 151 is placed into an underlying second joining feature of an underlying cage and then secured using a securing bolt (not shown but, for example, see FIG. 11B).

The first joining feature 151 may include a first hole 151A and a perpendicular second hole 151B so that the first joining feature 151 may be secured to a second joining feature 152 of an underlying cage from any side.

Figure 17F:
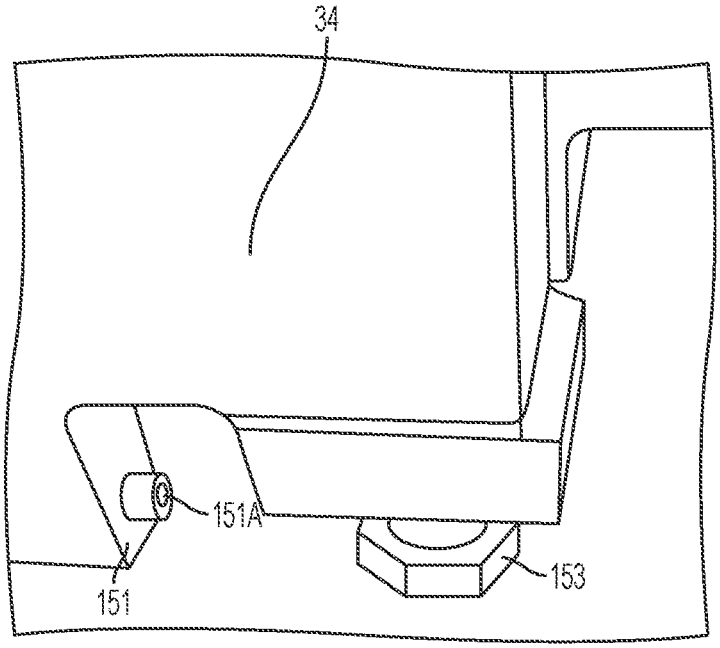

FIG. 17F illustrates a magnified back side projection view showing the first joining feature 151 and the jack screw 153. The back side view (along with FIG. 17E) also shows that the first hole 151A is a through hole extending completely through the first joining feature 151.

In various embodiments, the assembled multi-panel display system includes no cabinets. The assembled multi-panel display system is cooled passively and includes no air conditioning or fans.

Figure 18:
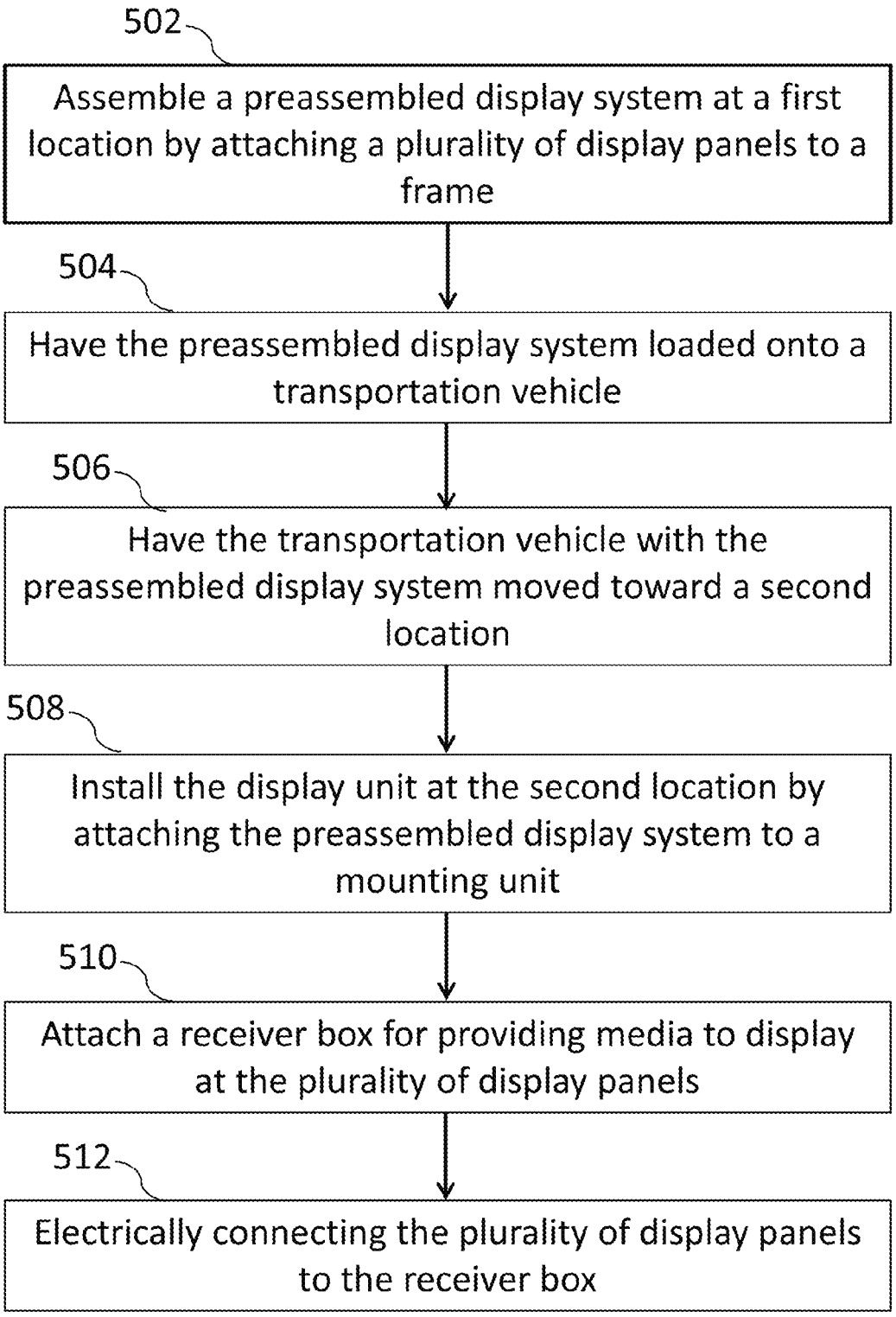
FIG. 18 illustrates a method of installing the display unit, which may be either a billboard or mounted directly on a wall of a building.

FIG. 18 illustrates a method of installing the display unit, which may be either a billboard or mounted directly on a wall of a building. A preassembled display system is assembled at a first location by attaching a plurality of display panels to a frame (box 502). In various embodiments, the preassembled display system may be at least 6 ft. long, for example, may be at least 6 ft.×12 ft. in one embodiment. The first location may be an assembling facility or a warehouse in various embodiments. The preassembled display system is loaded onto a transportation vehicle (box 504). For example, the preassembled display system may be loaded onto a shipping truck or rail cart. In various embodiments, multiple shipping carriers may be used. Next, the preassembled display system is moved to a second location in a transportation vehicle (box 506). The second location may be the final location at which the display system is to be set up. The display unit is installed at the second location by attaching the preassembled display system to a mounting unit (box 508). A preexisting display may be removed before installing the display unit at the second location. The attaching may be performed by lifting up the preassembled display system as a single unit to the mounting unit.

A receiver box for providing media to display at the plurality of display panels is attached (box 510). In various embodiments, the attaching may be performed at the first location and/or at the second location. The plurality of display panels are electrically connected to the receiver box (box 512). Again, the electrically connecting may be performed at the first location and/or at the second location.

Figure 19:
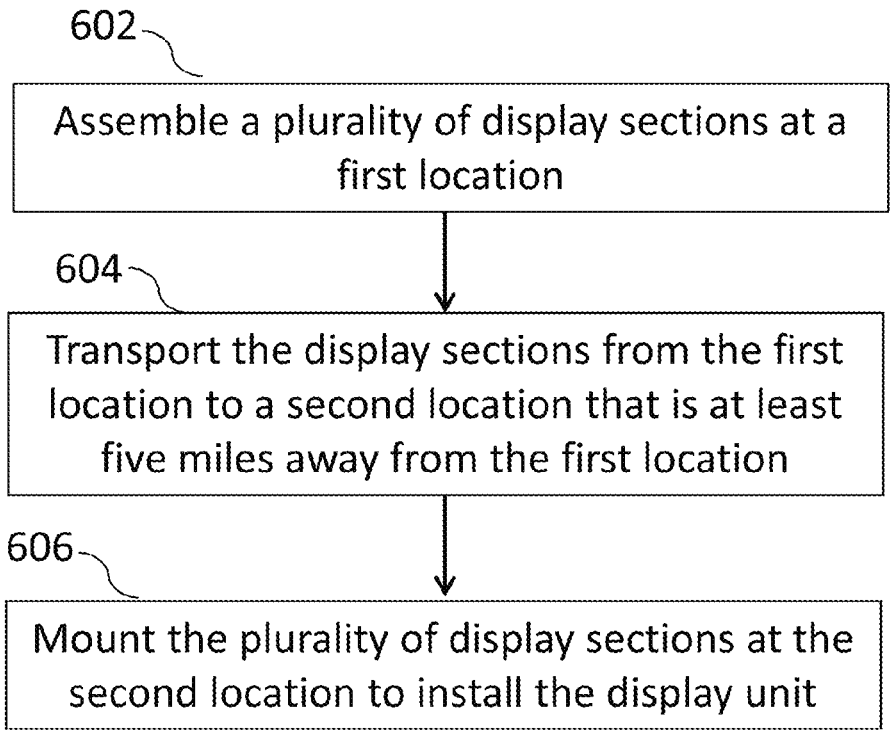
FIG. 19 illustrates a method of performing an installation of a display unit, which may be either a billboard or mounted directly on a wall of a building.

FIG. 19 illustrates a method of performing an installation of a display unit, which may be either a billboard or mounted directly on a wall of a building. Referring to FIG. 19, a plurality of display sections is assembled at a first location (602). Each display section includes a plurality of display panels mechanically attached to a frame. The assembled display sections are transported from the first location to a second location that is at least five miles away from the first location (box 604). The plurality of display sections is mounted at the second location to install the display unit (box 606). The display unit may be installed by attaching the frame of each display section to the frame of at least one other display section.

Although embodiments of the present invention have been described as being LED display panels, various embodiments of the present invention may also be applied to any type of display panel including organic displays including passive-matrix or active-matrix displays, organic transistor based displays, micro-mirror displays, plasma displays, liquid crystal displays, surface-conduction electron-emitter displays, field emission displays, and others.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of performing an installation of a display unit, the method comprising:

forming a preassembled display system at a first location by attaching a plurality of display panels to a frame, the preassembled display system being at least 6 ft.×12 ft., wherein each of the plurality of display panels comprises a housing having a recess, the housing comprising attachment points for attachment to adjacent ones of the plurality of display panels, exactly one printed circuit board disposed in the recess, and a plurality of light emitting diodes (LEDs) attached to the printed circuit board;

having the preassembled display system loaded onto a transportation vehicle;

having the transportation vehicle with the preassembled display system moved toward a second location;

at the second location, removing a preexisting display mounted on a mounting frame of a billboard; and lifting up the preassembled display system as a single unit to the mounting frame and having the preassembled display system attached to the mounting frame of the billboard, wherein, after the installation of the display unit, surfaces of the housing of each of the plurality of display panels at both a first side of the housing and an opposite second side of the housing are exposed to an external environment.

2. The method of claim 1, wherein the preassembled display system comprises a catwalk and a ladder.

3. The method of claim 1, wherein the preexisting display comprises a poster board mounted onto the mounting frame, and a canvas mounted over the poster board, and wherein removing the preassembled display system comprises removing the canvas and the poster board.

4. The method of claim 1, wherein, the housing of each of the plurality of display panels comprises a thermally conductive material, the plurality of LEDs of each of the plurality of display panels are attached to a first side of the printed circuit board, and each of the plurality of display panels comprises a power supply unit for powering the plurality of LEDs, wherein the power supply unit is disposed at a second side of the printed circuit board, the second side being opposite the first side.

5. The method of claim 1, wherein the preassembled display system is further configured to be attached to the mounting frame of the billboard by attaching a plurality of the preassembled display systems to the mounting frame of the billboard, a first one of the plurality of the preassembled display systems is stacked over a second one of the plurality of the preassembled display systems using joining features coupled to the frames of the first one and the second one of the plurality of the preassembled display systems, and the joining features are configured to facilitate alignment of the first one and the second one of the plurality of the preassembled display systems.

6. The method of claim 1, wherein the display unit is non-linear.

7. A method of performing an installation of a display unit, the method comprising forming a preassembled display system at a first location by attaching a plurality of display panels to a frame, the preassembled display system being at least 6 ft.×12 ft., wherein each of the plurality of display panels comprises:

a housing having a recess, the housing comprising attachment points for attachment to adjacent ones of the plurality of display panels;

exactly one printed circuit board disposed in the recess; and a plurality of light emitting diodes (LEDs) attached to the printed circuit board, and wherein the preassembled display system is configured to:

be loaded onto a transportation vehicle;

be moved on the transportation vehicle toward a second location at least five miles away from the first location; and be lifted up as a single unit to a mounting point at the second location and be attached to the mounting point, wherein, after the installation of the display unit, surfaces of the housing of each of the plurality of display panels at both a first side of the housing and an opposite second side of the housing are exposed to an external environment.

8. The method of claim 7, wherein the mounting point is on a wall of a building.

9. The method of claim 7, wherein the mounting point is on a preexisting billboard.

10. The method of claim 7, wherein each of the plurality of display panels comprises an encasement comprising a first thermally conductive material, a printed circuit board, a plurality of light emitters attached to a first side of the printed circuit board, and a power supply unit for powering the light emitters, the power supply unit disposed on a second side of the printed circuit board, the second side being opposite the first side, wherein a second thermally conductive material is disposed between the printed circuit board and the power supply unit.

11. The method of claim 10, wherein the first thermally conductive material and the second thermally conductive material are the same.

12. The method of claim 10, wherein the first thermally conductive material comprises plastic and the second thermally conductive material comprises aluminum.

13. A method of performing an installation of a display unit, the method comprising:

receiving at a first location one or more preassembled display sections from a second location, the one or more preassembled display sections each comprising a plurality of display panels attached to a frame in an array of columns and rows, wherein each of the plurality of display panels comprises a housing having a recess, the housing comprising attachment points for attachment to adjacent ones of the plurality of display panels, exactly one printed circuit board disposed in the recess, and a plurality of light emitting diodes (LEDs) attached to the printed circuit board; and mounting the one or more preassembled display sections at the second location to install the display unit, wherein each preassembled display section is lifted up as a single unit to a mounting point, wherein, after the installation of the display unit, surfaces of the housing of each of the plurality of display panels at both a first side of the housing and an opposite second side of the housing are exposed to an external environment.

14. The method of claim 13, wherein at least two of the one or more preassembled display sections are stacked vertically, and wherein the at least two of the one or more preassembled display sections are vertically aligned using joining features coupled to the frames of the preassembled display sections.

15. The method of claim 14, wherein the joining features comprise at least one of the group consisting of telescopic joints, slip joints, and ball and socket joints.

16. The method of claim 13, wherein mounting the one or more preassembled display sections further comprises mounting the one or more preassembled display sections to a wall.

17. The method of claim 13, wherein mounting the one or more preassembled display sections further comprises mounting the one or more preassembled display sections to a preexisting billboard.

18. The method of claim 13, wherein each frame of the one or more preassembled display sections comprises an outer frame with a top beam, a bottom beam, a left outside beam, and a right outside beam.

19. The method of claim 13, wherein the one or more preassembled display sections received at the first location are received in a shipping configuration, the shipping configuration comprising at least two preassembled display sections attached on opposite sides of a support frame.

20. The method of claim 19, wherein the support frame comprises a triangular shape.

* * * * *